US009126790B2

(12) United States Patent
Ooba

(10) Patent No.: US 9,126,790 B2
(45) Date of Patent: Sep. 8, 2015

(54) IMAGE FORMING APPARATUS THAT DETECTS REMAINING SHEET AMOUNT, INFORMATION TERMINAL, CONTROL METHOD, AND STORAGE MEDIUM

(75) Inventor: Hideaki Ooba, Sagamihara (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 13/464,065

(22) Filed: May 4, 2012

(65) Prior Publication Data

US 2012/0286465 A1 Nov. 15, 2012

(30) Foreign Application Priority Data

May 10, 2011 (JP) ..... 2011-105085

(51) Int. Cl.
*B65H 3/44* (2006.01)
*B65H 5/26* (2006.01)
*B65H 7/04* (2006.01)

(52) U.S. Cl.
CPC .. *B65H 3/44* (2013.01); *B65H 5/26* (2013.01); *B65H 7/04* (2013.01); *B65H 2511/152* (2013.01); *B65H 2511/30* (2013.01); *B65H 2551/20* (2013.01); *B65H 2801/06* (2013.01)

(58) Field of Classification Search
CPC ..... B65H 7/02; B65H 7/04; B65H 1/26; B65H 1/28; B65H 2601/322; B65H 2601/421; B65H 2405/331; B65H 2405/332
USPC ..... 271/9.02, 9.03, 9.06; 399/79, 81, 82, 399/83, 85, 86; 377/13, 16
See application file for complete search history.

(56) References Cited

U.S. PATENT DOCUMENTS

| | | | | |
|---|---|---|---|---|
| 8,002,259 | B2 * | 8/2011 | Kishimoto et al. | 271/9.01 |
| 8,342,501 | B2 * | 1/2013 | Yoshimura et al. | 271/9.02 |
| 2009/0261524 | A1 * | 10/2009 | Nakayama et al. | 271/3.14 |
| 2010/0225047 | A1 * | 9/2010 | Yoshimura et al. | 271/9.07 |

FOREIGN PATENT DOCUMENTS

JP 11-001051 A 1/1999

* cited by examiner

*Primary Examiner* — Thomas Morrison
(74) *Attorney, Agent, or Firm* — Rossi, Kimms & McDowell LLP

(57) ABSTRACT

An image forming apparatus capable of collectively and accurately detecting the remaining sheet amount of sheets set in sheet feed trays. The remaining sheet amount value of each sheet feed tray is detected in stepwise levels. Whenever sheet feed is detected, the remaining sheet count is decremented by 1. Upon detection of a change in the remaining sheet amount value, the changed remaining sheet amount value is acquired, and the remaining sheet count is changed to the changed remaining sheet amount value. If the sheet feed trays include any other one set to the same type and size of sheets as those of sheets to which the sheet feed tray in current use is set, when the remaining sheet count of the sheet feed tray in current use is changed to the changed remaining sheet amount value, the other sheet feed tray is selected for feeding sheets.

10 Claims, 13 Drawing Sheets

*FIG. 9*

| | SHEET FEED TRAY 105 | SHEET FEED TRAY 106 | SHEET FEED TRAY 120 | SHEET FEED TRAY 121 | SHEET FEED TRAY 122 |
|---|---|---|---|---|---|
| REMAINING SHEET COUNT | 1000 | 1000 | 1500 | 500 | 500 |
| ACTUAL REMAINING SHEET AMOUNT | 1400 | 1100 | 1500 | 900 | 750 |
| REMAINING SHEET AMOUNT FLAG | OFF | OFF | ON | OFF | OFF |

*FIG. 10*

| | SHEET FEED TRAY 105 | SHEET FEED TRAY 106 | SHEET FEED TRAY 120 | SHEET FEED TRAY 121 | SHEET FEED TRAY 122 |
|---|---|---|---|---|---|
| REMAINING SHEET COUNT | 1000 | 1000 | 1500 | 500 | 500 |
| ACTUAL REMAINING SHEET AMOUNT | 1000 | 1100 | 1500 | 900 | 750 |
| REMAINING SHEET AMOUNT FLAG | ON | OFF | ON | OFF | OFF |

IMAGE FORMING APPARATUS THAT DETECTS REMAINING SHEET AMOUNT, INFORMATION TERMINAL, CONTROL METHOD, AND STORAGE MEDIUM

BACKGROUND OF THE INVENTION

1. Field of the Invention

The present invention relates to an image forming apparatus for forming images on sheets, and an information terminal for controlling the image forming apparatus, and more particularly to a technique for accurately detecting the remaining sheet amount of a sheet feed tray that feeds sheets on which images are to be formed by the image forming apparatus.

2. Description of the Related Art

In an image forming apparatus that forms images on sheets, the remaining sheet amount of a sheet feed tray is detected by mounting one of various types of sheet detection sensors for detecting the remaining sheet amount on the sheet feed tray. When a change in the remaining sheet amount is detected by the sheet detection sensor, the image forming apparatus updates the remaining sheet amount of the sheet feed tray. More specifically, the image forming apparatus does not detect the remaining sheets in the sheet feed tray on a sheet basis, but stores values of the remaining sheet amount as respective detectable levels depending on the accuracy of the sheet detection sensor, and hence the remaining sheet amount has a predetermined range. Assuming that the sheet detection sensor detects the remaining sheet amount in four levels, the remaining sheet amounts to be detected are "0", "⅓of the maximum value of the remaining sheet amount of the sheet feed tray", "⅔of the maximum value of the remaining sheet amount of the sheet feed tray", and "the maximum value (3/3) of the remaining sheet amount of the sheet feed tray".

In general, a user using an image forming apparatus compares the number of sheets to be used in a print job the user is about to execute and a remaining sheet amount value detected by a sheet detection sensor, and considers whether or not there is a sufficient remaining sheet amount for executing the print job. If the user determines that the remaining sheet amount is insufficient, the user is required to replenish the sheet feed tray to make up for the insufficiency of sheets. At this time, whether or not an accurate remaining sheet amount value can be notified to the user depends on the detection accuracy of the sheet detection sensor.

For users who rarely perform large-volume printing, the necessity for acquiring an accurate remaining sheet amount value may be low. However, users under a POD (print on demand) environment often execute a print job for printing a large number of pages. The user schedules the print job, and performs printing in such a manner that the image forming apparatus is not stopped e.g. due to a sheet run-out error. When using the image forming apparatus in such a manner, it is necessary for the user to know what kind of sheets are required to be set in a sheet feed tray in what amount, and hence the image forming apparatus is needed to acquire a remaining sheet amount value which is as accurate as possible and provide the same to the user.

As a technique meeting such a need, there has been proposed a technique which corrects a remaining sheet amount value by using a counter for counting the number of sheets held in the image forming apparatus and a sheet detection sensor provided for a sheet feed tray (see Japanese Patent Laid-Open Publication No. H11-1051). In this technique, when the corrected remaining sheet amount value becomes lower than a detection value to be detected by the sheet detection sensor (e.g. when the corrected remaining sheet amount value is not larger than 0), the correction of the remaining sheet amount value is not performed.

In the above-described conventional technique, the correction of the remaining sheet amount is performed only on a single sheet feed tray, and hence even after the remaining sheet amount value of the single sheet feed tray is finally determined, sheet feed from the single sheet feed tray continues to be executed. On the other hand, an image forming apparatus is widely used which includes a plurality of sheet feed trays and is capable of feeding a large number of sheets. The user who uses such an image forming apparatus under the POD environment sets sheets of the same type and the same size in a plurality of sheet feed trays. Further, an automatic sheet feed tray-changing function is sometimes used which, when one sheet feed tray becomes empty (one sheet feed tray runs out of sheets), enables sheets to be automatically fed from another sheet feed tray in which sheets of the same type and the same size are set.

If such a method of using the image forming apparatus is applied to the above-described conventional technique, after the remaining sheet amount value of one sheet feed tray is accurately detected, sheets continue to be fed from the same sheet feed tray, and when the remaining sheet amount value of the sheet feed tray becomes equal to 0, the sheet feed tray is automatically changed to a next sheet feed tray so as to feed sheets from the next sheet feed tray.

However, this brings about the problem that when a plurality of sheet feed trays are set to the same type and the same size, it is impossible to sum up the remaining sheet amounts of all the sheet feed trays and check the total sheet amount. The same problem also occurs in an image forming apparatus which is capable of grouping sheet feed trays and setting sheets of the same type and the same size in a group of a plurality of sheet feed trays at a time.

SUMMARY OF THE INVENTION

The present invention provides an image forming apparatus which is capable of collectively and accurately detecting the remaining sheet amounts of sheets set in a plurality of sheet feed trays.

In a first aspect of the present invention, there is provided an image forming apparatus including a plurality of sheet feed trays, comprising a remaining sheet amount-detecting unit configured to detect a remaining sheet amount value of each of the plurality of sheet feed trays, in stepwise levels, a remaining sheet count-holding unit configured to hold a remaining sheet count of each of the plurality of sheet feed trays, the remaining sheet count being set to the remaining sheet amount value of an associated one of the sheet feed trays detected by said remaining sheet amount-detecting unit, a sheet feed-detecting unit configured to detect sheet feed from a sheet feed tray designated by a print job, which is one of the plurality of sheet feed trays, a remaining sheet count-correcting unit configured to be operable when said sheet feed-detecting unit detects the sheet feed from the designated sheet feed tray, to subtract 1 from the remaining sheet count of the designated sheet feed tray held by said remaining sheet count-holding unit whenever one sheet is fed from the designated sheet feed tray, to thereby correct the remaining sheet count of the designated sheet feed tray, an actual remaining sheet amount-dependent correction unit configured to be operable when there is a change in the remaining sheet amount value detected by said remaining sheet amount-detecting unit, to change the remaining sheet count of the designated sheet feed tray, which has been corrected by said remaining sheet count-correcting unit, to the remaining sheet amount value after the change detected by said remaining sheet amount-detecting unit, and a control unit configured to be operable, in a case where the plurality of sheet feed trays include any other sheet feed tray set to the same type and same size of sheets as the type and size of sheets to which the designated sheet feed tray in current use for feeding sheets is set, when said actual remaining sheet amount-dependent correction unit has changed the remaining sheet count of the sheet feed tray in current use for feeding sheets to the remaining sheet amount value after the change, to change sheet feed trays such that sheets are fed from the other sheet feed tray.

In a second aspect of the present invention, there is provided an image forming apparatus including a plurality of sheet feed trays, comprising a remaining sheet amount-detecting unit configured to detect a remaining sheet amount value of each of the plurality of sheet feed trays, in stepwise levels, a remaining sheet count-holding unit configured to hold a remaining sheet count of each of the plurality of sheet feed trays, the remaining sheet count being set to the remaining sheet amount value of an associated one of the sheet feed trays detected by said remaining sheet amount-detecting unit, a sheet feed-detecting unit configured to detect sheet feed from a sheet feed tray designated by a print job, which is one of the plurality of sheet feed trays, a remaining sheet count-correcting unit configured to be operable when said sheet feed-detecting unit detects the sheet feed from the designated sheet feed tray, to subtract 1 from the remaining sheet count of the designated sheet feed tray held by said remaining sheet count-holding unit whenever one sheet is fed from the designated sheet feed tray, to thereby correct the remaining sheet count of the designated sheet feed tray, an actual remaining sheet amount-dependent correction unit configured to be operable when there is a change in the remaining sheet amount value detected by said remaining sheet amount-detecting unit, to change the remaining sheet count of the designated sheet feed tray, which has been corrected by said remaining sheet count-correcting unit, to the remaining sheet amount value after the change detected by said remaining sheet amount-detecting unit, and a control unit configured to be operable, in a case where the plurality of sheet feed trays include any other sheet feed tray which is grouped with the designated sheet feed tray in current use for feeding sheets into the same group, when said actual remaining sheet amount-dependent correction unit has changed the remaining sheet count of the sheet feed tray in current use for feeding sheets to the remaining sheet amount value after the change, to change sheet feed trays such that sheets are fed from the other sheet feed tray.

In a third aspect of the present invention, there is provided an information terminal communicably connected to an image forming apparatus that includes a plurality of sheet feed trays and respective remaining sheet amount-detecting units configured to detect remaining sheet amount values of the plurality of sheet feed trays, in stepwise levels, comprising a first remaining sheet amount-acquiring unit configured to acquire the remaining sheet amount values detected by the remaining sheet amount-detecting units, a second remaining sheet amount-acquiring unit configured to be operable when any of the remaining sheet amount values detected by the remaining sheet amount-detecting units has changed, to acquire the changed remaining sheet amount value, a reception unit configured to receive, from the image forming apparatus, a notification of a sheet feed event or a sheet discharge event, which indicates that one sheet has been fed from a sheet feed tray of the plurality of sheet feed trays, which is designated by a print job, a remaining sheet count-correcting unit configured to be operable when the reception unit has received the notification, to subtract 1 from the remaining sheet amount value of the designated sheet feed tray acquired by the first remaining sheet amount-acquiring unit whenever the notification is received, to thereby correct the remaining sheet count of the designated sheet feed tray, an actual remaining sheet amount-dependent correction unit configured to be operable when there is a change in the remaining sheet amount value of the designated sheet feed tray detected by an associated one of the remaining sheet amount-detecting units, to change the remaining sheet count corrected by the remaining sheet count-correcting unit, to the changed remaining sheet amount value acquired by the second remaining sheet amount-acquiring unit, and a control unit configured to be operable, in a case where the plurality of sheet feed trays include any other sheet feed tray set to the same type and same size of sheets as the type and size of sheets to which the designated sheet feed tray in current use for feeding sheets is set, when the actual remaining sheet amount-dependent correction unit has changed the remaining sheet count of the sheet feed tray in current use for feeding sheets to the changed remaining sheet amount value acquired by the second remaining sheet amount-acquiring unit, to change sheet feed trays such that sheets are fed from the other sheet feed tray.

In a fourth aspect of the present invention, there is provided an information terminal communicably connected to an image forming apparatus that includes a plurality of sheet feed trays and respective remaining sheet amount-detecting units configured to detect remaining sheet amount values of the plurality of sheet feed trays, in stepwise levels, comprising a first remaining sheet amount-acquiring unit configured to acquire the remaining sheet amount values detected by the remaining sheet amount-detecting units, a second remaining sheet amount-acquiring unit configured to be operable when any of the remaining sheet amount values detected by the remaining sheet amount-detecting units has changed, to acquire the changed remaining sheet amount value, a reception unit configured to receive, from the image forming apparatus, a notification of a sheet feed event or a sheet discharge event, which indicates that one sheet has been fed from a sheet feed tray of the plurality of sheet feed trays, which is designated by a print job, a remaining sheet count-correcting unit configured to be operable when the reception unit has received the notification, to subtract 1 from the remaining sheet amount value of the designated sheet feed tray acquired by the first remaining sheet amount-acquiring unit whenever the notification is received, to thereby correct the remaining sheet count of the designated sheet feed tray, an actual remaining sheet amount-dependent correction unit configured to be operable when there is a change in the remaining sheet amount value of the designated sheet feed tray detected by an associated one of the remaining sheet amount-detecting units, to change the remaining sheet count corrected by the remaining sheet count-correcting unit, to the changed remaining sheet amount value acquired by the second remaining sheet amount-acquiring unit, and a control unit configured to be operable, in a case where the plurality of sheet feed trays include any other sheet feed tray which is grouped with the designated sheet feed tray in current use for feeding sheets into the same group, when the actual remaining sheet amount-dependent correction unit has changed the remaining sheet count of the sheet feed tray in current use for feeding sheets to the changed remaining sheet amount value, to change sheet feed trays such that sheets are fed from the other sheet feed tray.

In a fifth aspect of the present invention, there is provided a method of controlling an image forming apparatus including a plurality of sheet feed trays, comprising detecting a remaining sheet amount value of each of the plurality of sheet feed trays, in stepwise levels holding a remaining sheet count of each of the plurality of sheet feed trays, the remaining sheet count being set to the remaining sheet amount value of an associated one of the sheet feed trays detected, detecting sheet feed from a sheet feed tray designated by a print job, which is one of the plurality of sheet feed trays, subtracting, when the sheet feed from the designated sheet feed tray is detected, 1 from the held remaining sheet count of the designated sheet feed tray whenever one sheet is fed from the designated sheet feed tray, to thereby correct the remaining sheet count of the designated sheet feed tray, changing, when there is a change in the detected remaining sheet amount value, the remaining sheet count of the designated sheet feed tray, which has been corrected, to the detected remaining sheet amount value after the change, and changing, in a case where the plurality of sheet feed trays include any other sheet feed tray set to the same type and same size of sheets as the type and size of sheets to which the designated sheet feed tray in current use for feeding sheets is set, when the remaining sheet count of the sheet feed tray in current use for feeding sheets has been changed to the remaining sheet amount value after the change, sheet feed trays such that sheets are fed from the other sheet feed tray.

In a sixth aspect of the present invention, there is provided a method of controlling an image forming apparatus including a plurality of sheet feed trays, comprising detecting a remaining sheet amount value of each of the plurality of sheet feed trays, in stepwise levels, holding a remaining sheet count of each of the plurality of sheet feed trays, the remaining sheet count being set to the remaining sheet amount value of an associated one of the sheet feed trays detected, detecting sheet feed from a sheet feed tray designated by a print job, which is one of the plurality of sheet feed trays, subtracting, when the sheet feed from the designated sheet feed tray is detected, 1 from the held remaining sheet count of the designated sheet feed tray whenever one sheet is fed from the designated sheet feed tray, to thereby correct the remaining sheet count of the designated sheet feed tray, changing, when there is a change in the detected remaining sheet amount value, the remaining sheet count of the designated sheet feed tray, which has been corrected, to the detected remaining sheet amount value after the change, and changing, in a case where the plurality of sheet feed trays include any other sheet feed tray which is grouped with the designated sheet feed tray in current use for feeding sheets into the same group, when the remaining sheet count of the sheet feed tray in current use for feeding sheets has been changed to the remaining sheet amount value after the change, sheet feed trays such that sheets are fed from the other sheet feed tray.

In a seventh aspect of the present invention, there is provided a method of controlling an information terminal communicably connected to an image forming apparatus that includes a plurality of sheet feed trays and respective remaining sheet amount-detecting units configured to detect remaining sheet amount values of the plurality of sheet feed trays, in stepwise levels, comprising acquiring the remaining sheet amount values detected by the remaining sheet amount-detecting units, acquiring, when any of the remaining sheet amount values detected by the remaining sheet amount-detecting units has changed, the changed remaining sheet amount value, receiving, from the image forming apparatus, a notification of a sheet feed event or a sheet discharge event, which indicates that one sheet has been fed from a sheet feed tray of the plurality of sheet feed trays, which is designated by a print job, subtracting, when the reception unit has received the notification, 1 from the acquired remaining sheet amount value of the designated sheet feed tray whenever the notification is received, to thereby correct the remaining sheet count of the designated sheet feed tray, changing, when there is a change in the detected remaining sheet amount value, the corrected remaining sheet count, to the acquired changed remaining sheet amount value, and changing, in a case where the plurality of sheet feed trays include any other sheet feed tray set to the same type and same size of sheets as the type and size of sheets to which the designated sheet feed tray in current use for feeding sheets is set, when the remaining sheet count of the sheet feed tray in current use for feeding sheets has been changed to the acquired changed remaining sheet amount value, sheet feed trays such that sheets are fed from the other sheet feed tray.

In an eighth aspect of the present invention, there is provided a method of controlling an information terminal communicably connected to an image forming apparatus that includes a plurality of sheet feed trays and respective remaining sheet amount-detecting units configured to detect remaining sheet amount values of the plurality of sheet feed trays, in stepwise levels, comprising acquiring the remaining sheet amount values detected by the remaining sheet amount-detecting units, acquiring, when any of the remaining sheet amount values detected by the remaining sheet amount-detecting units has changed, to acquire the changed remaining sheet amount value, receiving, from the image forming apparatus, a notification of a sheet feed event or a sheet discharge event, which indicates that one sheet has been fed from a sheet feed tray of the plurality of sheet feed trays, which is designated by a print job, subtracting, when the notification has been received, 1 from the acquired remaining sheet amount value of the designated sheet feed tray whenever the notification is received, to thereby correct the remaining sheet count of the designated sheet feed tray, changing, when there is a change in the detected remaining sheet amount value, the corrected remaining sheet count to the acquired changed remaining sheet amount value, and changing, in a case where the plurality of sheet feed trays include any other sheet feed tray which is grouped with the designated sheet feed tray in current use for feeding sheets into the same group, when the remaining sheet count of the sheet feed tray in current use for feeding sheets has been changed to the changed remaining sheet amount value, sheet feed trays such that sheets are fed from the other sheet feed tray.

In a ninth aspect of the present invention, there is provided a non-transitory computer-readable storage medium storing a computer-executable program for causing a computer to execute a method of controlling an image forming apparatus including a plurality of sheet feed trays, wherein the method comprises detecting a remaining sheet amount value of each of the plurality of sheet feed trays, in stepwise levels, holding a remaining sheet count of each of the plurality of sheet feed trays, the remaining sheet count being set to the remaining sheet amount value of an associated one of the sheet feed trays detected, detecting sheet feed from a sheet feed tray designated by a print job, which is one of the plurality of sheet feed trays, subtracting, when the sheet feed from the designated sheet feed tray is detected, 1 from the held remaining sheet count of the designated sheet feed tray whenever one sheet is fed from the designated sheet feed tray, to thereby correct the remaining sheet count of the designated sheet feed tray, changing, when there is a change in the detected remaining sheet amount value, the remaining sheet count of the designated sheet feed tray, which has been corrected, to the detected remaining sheet amount value after the change, and changing, in a case where the plurality of sheet feed trays include any other sheet feed tray set to the same type and same size of sheets as the type and size of sheets to which the designated sheet feed tray in current use for feeding sheets is set, when the remaining sheet count of the sheet feed tray in current use for feeding sheets has been changed to the remaining sheet amount value after the change, sheet feed trays such that sheets are fed from the other sheet feed tray.

In a tenth aspect of the present invention, there is provided a non-transitory computer-readable storage medium storing a computer-executable program for causing a computer to execute a method of controlling an image forming apparatus including a plurality of sheet feed trays, wherein the method comprises detecting a remaining sheet amount value of each of the plurality of sheet feed trays, in stepwise levels, holding a remaining sheet count of each of the plurality of sheet feed trays, the remaining sheet count being set to the remaining sheet amount value of an associated one of the sheet feed trays detected, detecting sheet feed from a sheet feed tray designated by a print job, which is one of the plurality of sheet feed trays, subtracting, when the sheet feed from the designated sheet feed tray is detected, 1 from the held remaining sheet count of the designated sheet feed tray whenever one sheet is fed from the designated sheet feed tray, to thereby correct the remaining sheet count of the designated sheet feed tray, changing, when there is a change in the detected remaining sheet amount value, the remaining sheet count of the designated sheet feed tray, which has been corrected, to the detected remaining sheet amount value after the change, and changing, in a case where the plurality of sheet feed trays include any other sheet feed tray which is grouped with the designated sheet feed tray in current use for feeding sheets into the same group, when the remaining sheet count of the sheet feed tray in current use for feeding sheets has been changed to the remaining sheet amount value after the change, sheet feed trays such that sheets are fed from the other sheet feed tray.

In an eleventh aspect of the present invention a non-transitory computer-readable storage medium storing a computer-executable program for causing a computer to execute a method of controlling an information terminal communicably connected to an image forming apparatus that includes a plurality of sheet feed trays and respective remaining sheet amount-detecting units configured to detect remaining sheet amount values of the plurality of sheet feed trays, in stepwise levels, wherein the method comprises acquiring the remaining sheet amount values detected by the remaining sheet amount-detecting units, acquiring, when any of the remaining sheet amount values detected by the remaining sheet amount-detecting units has changed, the changed remaining sheet amount value, receiving, from the image forming apparatus, a notification of a sheet feed event or a sheet discharge event, which indicates that one sheet has been fed from a sheet feed tray of the plurality of sheet feed trays, which is designated by a print job, subtracting, when the reception unit has received the notification, 1 from the acquired remaining sheet amount value of the designated sheet feed tray whenever the notification is received, to thereby correct the remaining sheet count of the designated sheet feed tray, changing, when there is a change in the detected remaining sheet amount value, the corrected remaining sheet count, to the acquired changed remaining sheet amount value, and changing, in a case where the plurality of sheet feed trays include any other sheet feed tray set to the same type and same size of sheets as the type and size of sheets to which the designated sheet feed tray in current use for feeding sheets is set, when the remaining sheet count of the sheet feed tray in current use for feeding sheets has been changed to the acquired changed remaining sheet amount value, sheet feed trays such that sheets are fed from the other sheet feed tray.

In a twelfth aspect of the present invention, there is provided a non-transitory computer-readable storage medium storing a computer-executable program for causing a computer to execute a method of controlling an information terminal communicably connected to an image forming apparatus that includes a plurality of sheet feed trays and respective remaining sheet amount-detecting units configured to detect remaining sheet amount values of the plurality of sheet feed trays, in stepwise levels, wherein the method comprises acquiring the remaining sheet amount values detected by the remaining sheet amount-detecting units, acquiring, when any of the remaining sheet amount values detected by the remaining sheet amount-detecting units has changed, to acquire the changed remaining sheet amount value, receiving, from the image forming apparatus, a notification of a sheet feed event or a sheet discharge event, which indicates that one sheet has been fed from a sheet feed tray of the plurality of sheet feed trays, which is designated by a print job, subtracting, when the notification has been received, 1 from the acquired remaining sheet amount value of the designated sheet feed tray whenever the notification is received, to thereby correct the remaining sheet count of the designated sheet feed tray, changing, when there is a change in the detected remaining sheet amount value, the corrected remaining sheet count to the acquired changed remaining sheet amount value, and changing, in a case where the plurality of sheet feed trays include any other sheet feed tray which is grouped with the designated sheet feed tray in current use for feeding sheets into the same group, when the remaining sheet count of the sheet feed tray in current use for feeding sheets has been changed to the changed remaining sheet amount value, sheet feed trays such that sheets are fed from the other sheet feed tray.

According to the present invention, it is possible to collectively and accurately detect the remaining sheet amounts of sheets set in a plurality of sheet feed trays.

Further features of the present invention will become apparent from the following description of exemplary embodiments with reference to the attached drawings.

BRIEF DESCRIPTION OF THE DRAWINGS

FIG. 9 is a view of a database of the printing apparatus shown in FIG. 1, which holds remaining sheet counts.

FIG. 10 is a view of an updated state of the database shown in FIG. 9.

DESCRIPTION OF THE EMBODIMENTS

The present invention will now be described in detail below with reference to the accompanying drawings showing embodiments thereof. In each of the embodiments described hereafter, a printing apparatus is taken as an example of an image forming apparatus, but the image forming apparatus according to the present invention can be applied to all types of image forming apparatuses, such as a copying machines and multifunction peripherals, which are each equipped with sheet feed trays.

Figure 1:
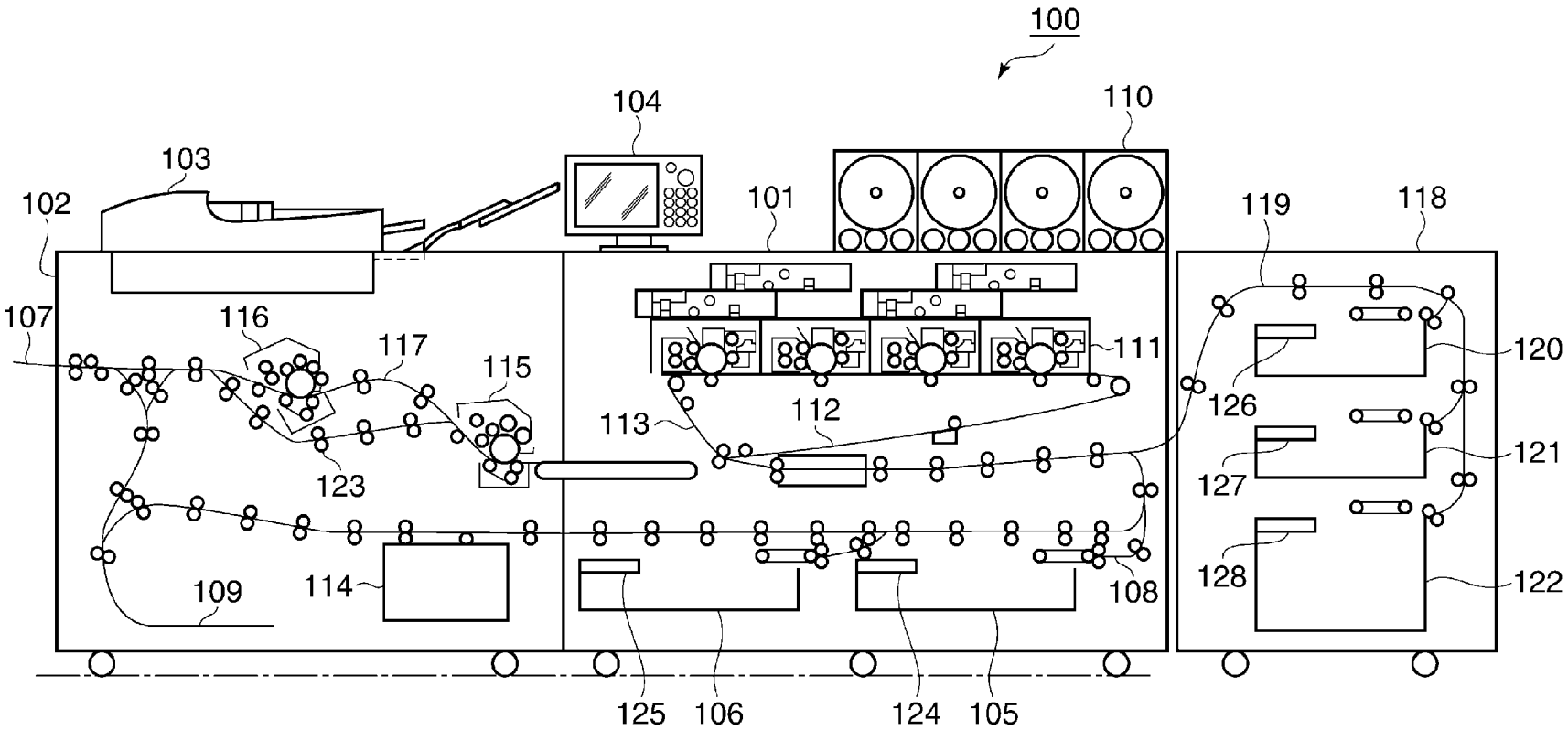
FIG. 1 is a cross-sectional view of a printing apparatus (image forming apparatus) according to a first embodiment of the present invention.

FIG. 1 is a cross-sectional view of a printing apparatus according to a first embodiment of the present invention. The printing apparatus 100 comprises an image forming section 101, a fixing section 102, a scanner section 103, a console section 104, a sheet discharge section 107, a toner replenishment section 110, and an external sheet-feeding device 118.

The image forming section 101 includes sheet feed trays (sheet feed trays) 105 and 106, a conveying section 108, a primary transfer section 111, a transfer belt 112, and a secondary transfer section 113. The fixing section 102 includes a switchback section 109, a waste toner collecting section 114, fixing units 115 and 116 and conveying sections 117 and 123. The external sheet-feeding device 118 includes a conveying section 119 and sheet feed trays (sheet feed trays) 120, 121 and 122.

The scanner section 103 scans an original to generate electronic data of an image of the original. The console section 104 includes hard keys and a touch panel display, for example, and receives various types of operator's instructions to the printing apparatus 100. The sheet feed trays 105, 106, 120, 121, and 122 (hereinafter also sometimes referred to as the "sheet feed trays 105 etc.") accommodate stacked sheets (recording materials) for printing by the printing apparatus 100. The sheet discharge section 107 discharges printed sheets out of the printing apparatus 100. The switchback section 109 inverts an output (image-formed) surface of each sheet when the sheet is discharged onto the sheet discharge section 107.

The toner replenishment section 110 replenishes the image forming section 101 with toner, which is developer. The primary transfer section 111 transfers a toner image formed based on image data onto the transfer belt 112. The secondary transfer section 113 transfers the toner image transferred on the transfer belt 112, onto a sheet. The waste toner collecting section 114 collects and stores excess toner generated in the course of the transfer process. The fixing unit 115 applies heat and pressure to the sheet having the toner image transferred thereon by the secondary transfer section 113, to thereby fix the toner on the sheet. The fixing unit 116 further applies heat and pressure to the sheet having the image fixed thereon by the fixing unit 115, for reinforcing the fixation of the image.

The conveying sections 108, 117, 119, and 123, as conveying paths along which sheets are conveyed, are provided with rollers for conveying sheets at regular intervals. The conveying section 117 conveys sheets from the fixing unit 115 to the fixing unit 116. The conveying section 123 conveys sheets from the fixing unit 115 to the sheet discharge section 107 or the switchback section 109 without passing through the fixing unit 116. The conveying sections 108 and 119 supply sheets to the secondary transfer section 113. The respective sheet feed trays 105, 106, 120, 121, and 122 are provided with respective remaining sheet amount-detecting sensors 124, 125, 126, 127, and 128, which are first remaining sheet amount-acquiring units for detecting remaining sheet amounts, i.e. the numbers of remaining sheets in the respective sheet feed trays (hereinafter also referred to as the "remaining sheet amount-detecting sensors 124 etc." as deemed appropriate).

Figure 2:
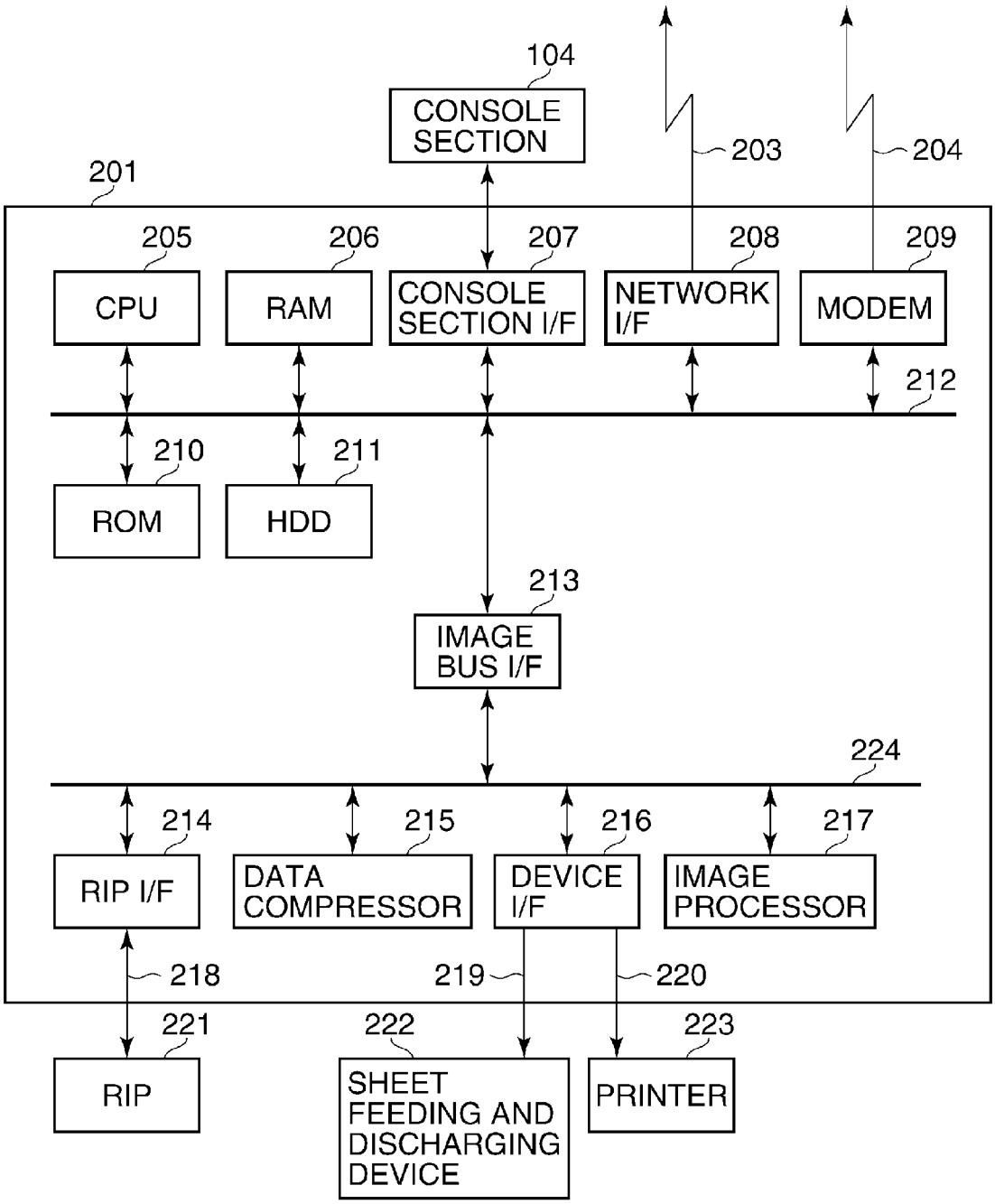
FIG. 2 is a block diagram of a control system of the printing apparatus shown in FIG. 1.

FIG. 2 is a block diagram of a control system of the printing apparatus 100. The entire operation of the printing apparatus 100 is controlled by a main controller 201. The main controller 201 comprises a CPU 205, a RAM 206, a console section interface (I/F) 207, a network interface (I/F) 208, a modem 209, a ROM 210, and an HDD 211, which are connected via a CPU bus 212. In the main controller 201, the CPU bus 212 and an image bus 224 are connected via an image bus interface (I/F) 213, and a RIP (raster image processor) interface (I/F) 214, a data compressor 215, a device interface (I/F) 216, and an image processor 217 are connected to the image bus 224.

A network cable 203 for connecting to external devices via a network is connected to the network interface 208. A line cable 204 for connecting to external devices via a telephone line is connected to the modem 209. The CPU 205 controls the overall operation of the main controller 201. The RAM 206 is managed by a program operating on the CPU 205, and is used as a receive buffer for temporarily storing data received from the outside, an image data buffer for temporarily storing image data rasterized by a RIP 221, or the like. The ROM 210 stores programs operating on the CPU 205, data, and so forth. The HDD 211 stores various data on a long term basis.

The console section interface 207 connects between the console section 104 and the main controller 201. The image bus interface 213 connects between the CPU bus 212 and the image bus 224. The RIP 221 is connected to the RIP interface 214 via a data bus 218. The RIP 221 is a rasterization board (RIP) having a function of converting externally input image description data to bitmap image data. The RIP interface 214 connects between the RIP 221 and the image bus 224 via the data bus 218. The data compressor 215 compresses data.

A sheet feeding and discharging device 222 is connected to the device interface 216 via a data bus 219, and a printer 223 is connected to the device interface 216 via a data bus 220. The sheet feeding and discharging device 222 represents a mechanical construction of the printing apparatus 100 for feeding and discharging sheets, and the printer 223 represents a construction of the printing apparatus 100 for forming images on sheets. These constructions are described hereinabove with reference to FIG. 1.

The CPU 205 issues a print command to the printer 223 and the sheet feeding and discharging device 222 via the data buses 219 and 220 according to an instruction signal transmitted from the console section 104 or an external device via the network cable 203. The image processor 217 performs various kinds of image processing on the bitmap image data generated by the RIP 221. The image processor 217 has a function of digitally processing bitmap image data, such as a function of combining two pages of bitmap image data into one page of bitmap image data.

In the present embodiment, handling a plurality of sheet feed trays as a virtual one unit is referred to as "grouping of sheet feed trays". Normally, in the case of a print job designating a sheet feed tray, when the designated sheet feed tray runs out of sheets, the printing apparatus 100 stops printing, and displays a message for replenishing the designated sheet feed tray with sheets, on the console section 104. In contrast, when the grouping of sheet feed trays has been performed, even if a designated sheet feed tray runs out of sheets, the print job continues to be carried out by using printable sheets, if any, contained in another sheet feed tray belonging to the same group.

Figure 3:
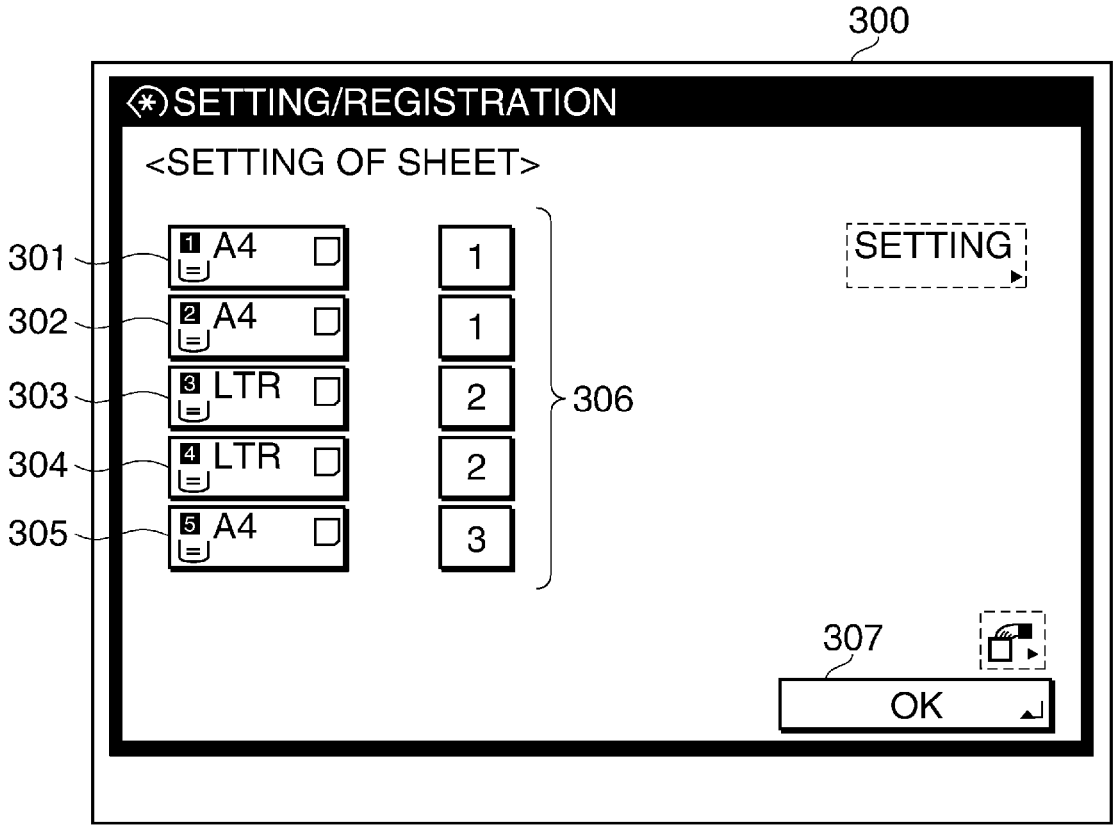
FIG. 3 is a view of a configuration screen for grouping sheet feed trays of the printing apparatus shown in FIG. 1.

FIG. 3 is a view of a configuration screen for grouping the sheet feed trays 105 etc., displayed on the console section 104. Information items on the sheet feed trays 105, 106, 120, 121, and 122 (serial numbers assigned to the sheet feed trays 105 etc., respectively, sheet sizes, and graphics representing remaining sheet amounts) are displayed on respective display frames 301, 302, 303, 304, and 305 on the configuration screen denoted by reference numeral 300.

Five grouping setting buttons 306 displayed on the configuration screen 300 indicate the group numbers of groups to which the respective sheet feed trays 105 etc. belong. In FIG. 3, the sheet feed trays 105 and 106 represented by the respective display frames 301 and 302 belong to a group 1, the sheet feed trays 120 and 121 represented by the respective display frames 303 and 304 belong to a group 2, and the sheet feed tray 122 represented by the display frame 305 belongs to a group 3.

Whenever each grouping setting button 306 is depressed once, the group number displayed on the button 306 is incremented by 1 to update (change) the display of the group number. The group number can be changed up to the same number as the total number of the sheet feed trays 105 etc. (up to 5 in the example illustrated in FIG. 3). When the grouping setting button 306 is further depressed in a state where the group number is equal to the total number of the sheet feed trays 105 etc., the group number returns to 1. When an OK button 307 provided on the configuration screen 300 is depressed, the CPU 205 stores the currently configured settings of grouping of the sheet feed trays 105 etc. in the RAM 206.

Figure 4:
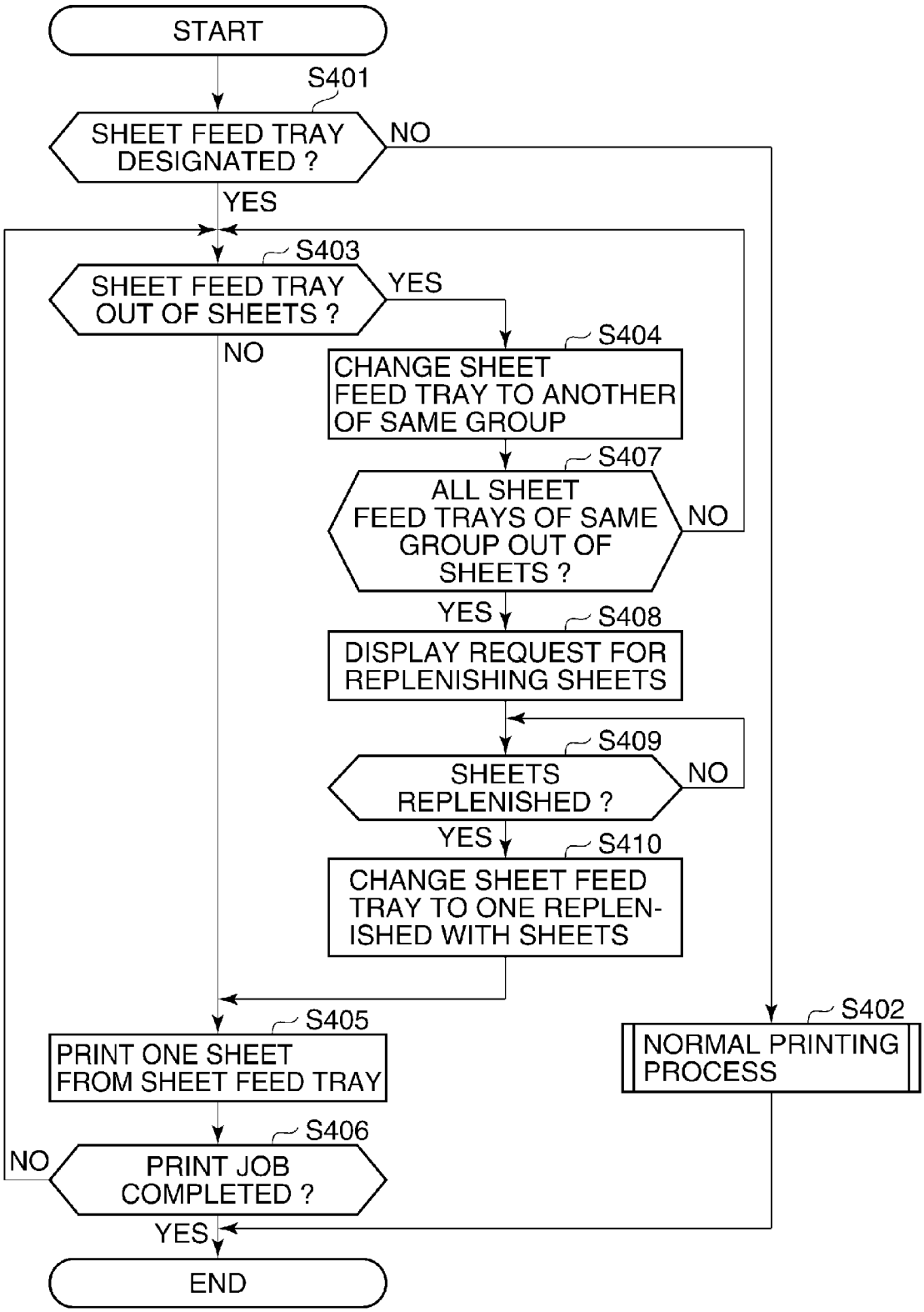
FIG. 4 is a flowchart of a printing process for performing a print job using grouped sheet feed trays of the printing apparatus shown in FIG. 1.

FIG. 4 is a flowchart of a printing process for performing a print job using grouped sheet feed trays. Note that the following description is given by generalizing the configuration of the printing apparatus to a configuration in which a plurality of sheet feed trays are provided, without limiting the number of sheet feed trays. The print job is executed by the CPU 205 by loading a program stored in the ROM 210 into a work area of the RAM 206, executing the program, and controlling various drive units as components of the printing apparatus 100.

Upon receipt of a signal for instructing the print job, the CPU 205 determines whether or not the print job designates a sheet feed tray (step S401). If no sheet feed tray is designated (NO to the step S401), the CPU 205 performs normal processing (step S402). Note that the conventional technique can be applied to the processing executed in the step S402, and hence description thereof is omitted.

If any sheet feed tray is designated (YES to the step S401), the CPU 205 determines whether or not the designated sheet feed tray has run out of sheets (step S403). If the designated sheet feed tray has not run out of sheets (NO to the step S403), the CPU 205 performs printing on a sheet fed from the designated sheet feed tray (step S405), and then determines whether or not the print job has been completed (step S406). If the print job has been completed (YES to the step S406), the CPU 205 terminates the present process, whereas if the print job has not been completed (NO to the step S406), the CPU 205 returns to the step S403.

If it is determined in the step S403 that the designated sheet feed tray has run out of sheets (YES to the step S403), the CPU 205 changes a sheet feed tray to be used for printing to another sheet feed tray belonging to the same group as the sheet feed tray having run out of sheets does (step S404). Then, the CPU 205 determines whether or not all the sheet feed trays belonging to the same group have run out of sheets (step S407). If there are usable sheets (NO to the step S407), the CPU 205 returns to the step S403. If all the sheet feed trays have run out of sheets (YES to the step S407), the CPU 205 instructs the console section 104 to display a sheet replenishment display screen (step S408), and determines whether or not sheets have been replenished (step S409).

If sheets have not been replenished (NO to the step S409), the CPU 205 repeatedly performs the determination until sheets are replenished (waits for sheets to be replenished). When sheets are replenished (YES to the step S409), the CPU 205 changes the sheet feed tray to be used for printing to a sheet feed tray replenished with the sheets in the step S409 (step S410), and then proceeds to the step S405. The printing apparatus 100 performs printing using the grouped sheet feed trays, as described above.

Figure 5:
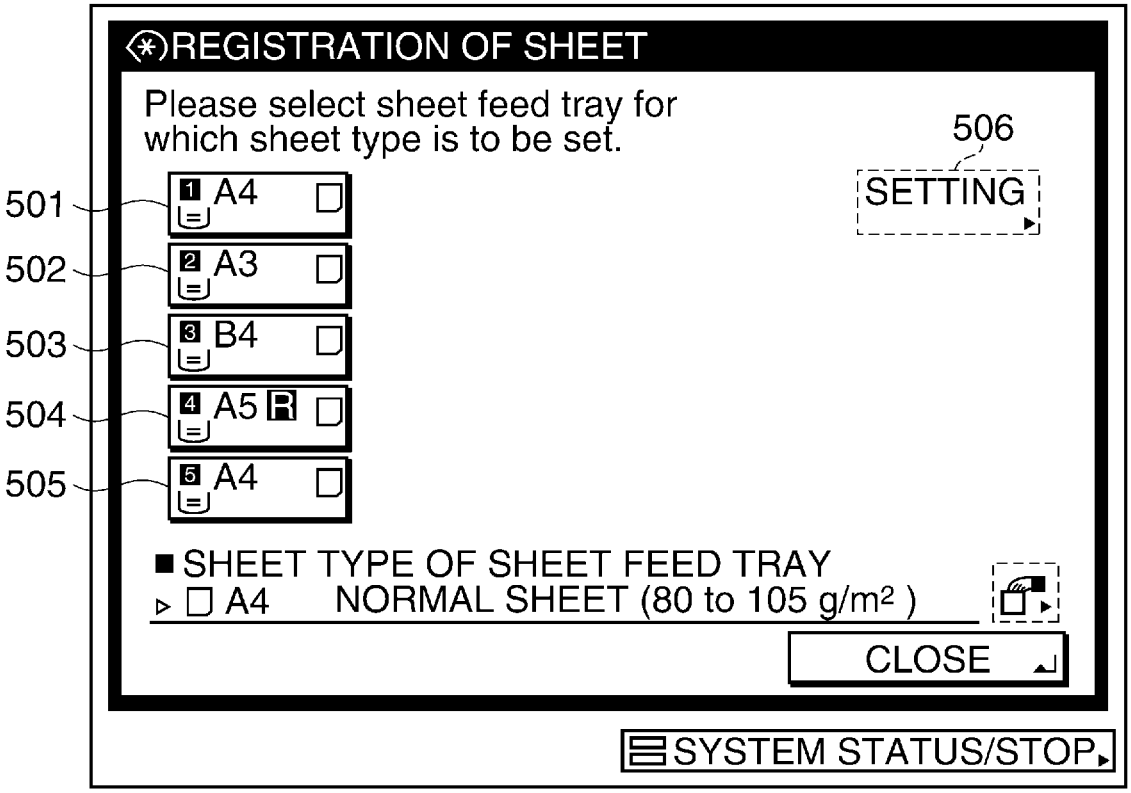
FIG. 5 is a view of a sheet setting change screen displayed on a console section of the printing apparatus shown in FIG. 1.

Next, a description will be given of operations performed from the console section 104 for setting the types of sheets for the respective sheet feed trays 105 etc. FIG. 5 shows an example of a sheet setting change screen displayed on the console section 104. The sheet setting change screen is displayed by the user by opening a sheet type registration screen on the console section 104. The user selects and depresses one of sheet feed tray selection buttons 501 to 505 on the sheet setting change screen, to thereby select a sheet feed tray desired to be changed in sheet type set therefor, and then depresses a setting button 506. With this operation, the CPU 205 loads settings of the sheet feed tray corresponding to the selected sheet feed tray selection button into the RAM 206, and displays a sheet attribute details-setting screen for the selected sheet feed tray on the console section 104.

Figure 6:
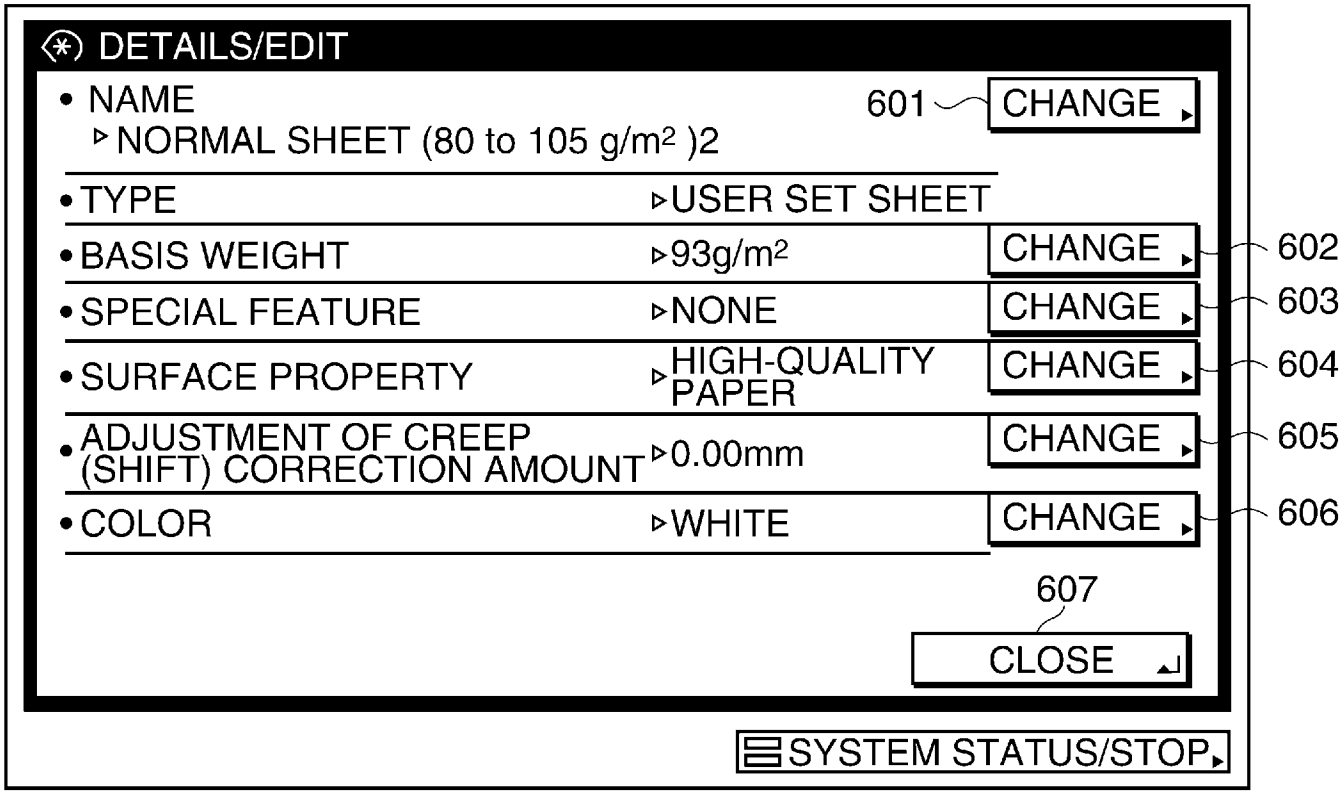
FIG. 6 is a view of a sheet attribute details-setting screen displayed on the console section of the printing apparatus shown in FIG. 1.

FIG. 6 shows an example of the sheet attribute details-setting screen. Changes in various attributes (name, type, basis weight, color, and so forth) displayed on the sheet attribute details-setting screen are accepted by depressing change buttons 601 to 606. Note that when a close button 607 is depressed, the screen returns to the sheet setting change screen shown in FIG. 5.

Figure 7:
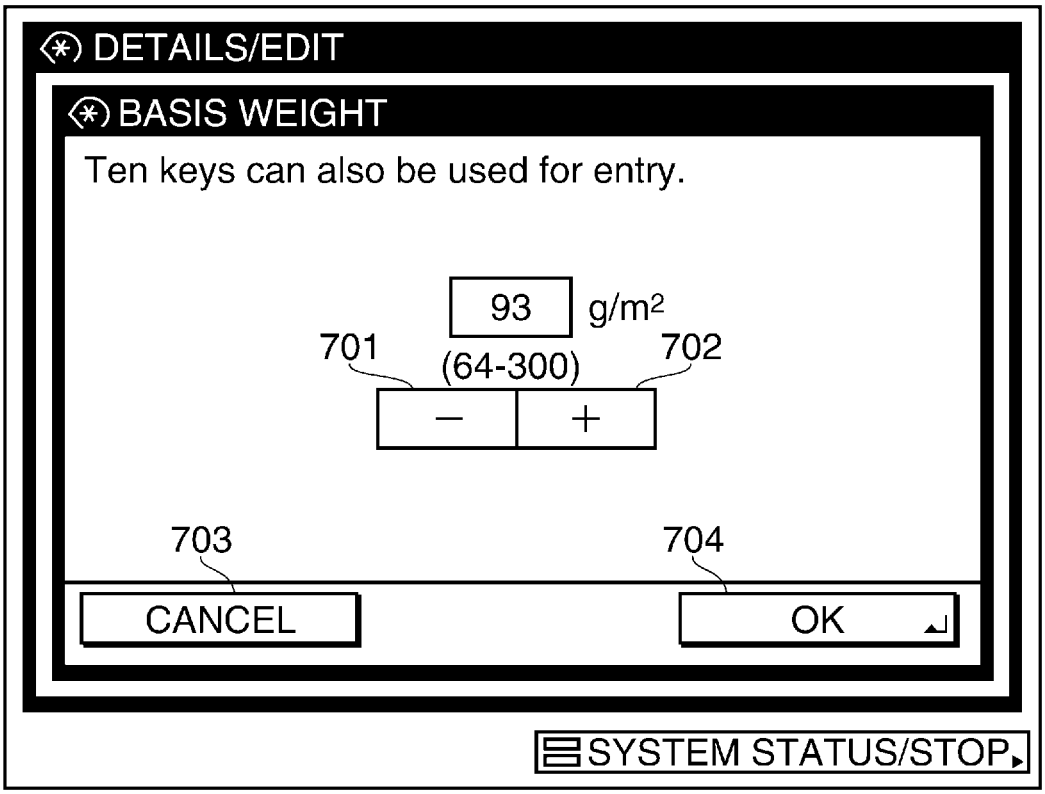
FIG. 7 is a view of a basis weight change screen displayed on the console section of the printing apparatus shown in FIG. 1.

For example, when a basis weight change button 602 is depressed, the CPU 205 causes the console section 604 to display a basis weight change screen. FIG. 7 shows an example of the basis weight change screen. The value of a basis weight is reduced by depressing a – (minus) button 701, and is increased by depressing a + (plus) button 702. A cancel button 703 cancels a change in the basis weight to return the value of the basis weight to a value displayed when the basis weight change screen is opened. When an OK button 704 is depressed, the CPU 205 sets the basis weight to a displayed value, and stores the value in the RAM 206.

Figure 8:
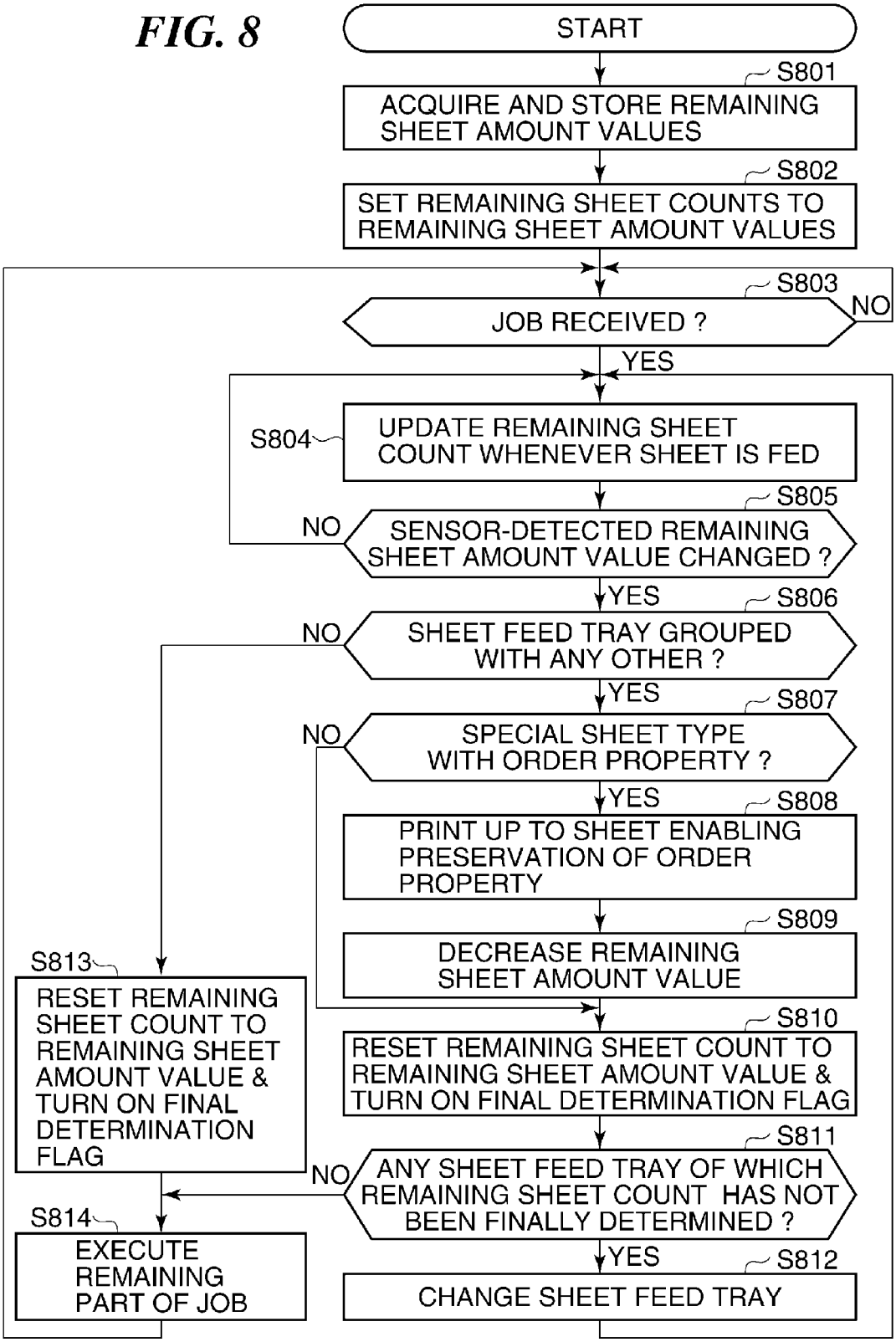
FIG. 8 is a flowchart of a remaining sheet count correction process executed by the printing apparatus shown in FIG. 1.

FIG. 8 is a flowchart of a remaining sheet count correction process for correcting values indicative of the numbers of remaining sheets (hereinafter each referred to as "remaining sheet count") set for the printing apparatus 100. When the user turns on the power of the printing apparatus 100, the CPU 205 starts up software, acquires remaining sheet amount values detected by the remaining sheet amount-detecting sensors 124 etc. (step S801). Note that the remaining sheet amount values are notified from the printer 223 to the device interface 216, and further are sent to the CPU 205 via the image bus interface 213. To acquire the remaining sheet amount values, it is possible to employ another method, such as a method of acquiring the same from the HDD 211 in which the notified remaining sheet amount values are once stored.

Each remaining sheet amount value notified from the printer 223 is defined in several levels. In the present embodiment, it is assumed that the detection range of the remaining sheet amount value is divided into four levels. That is, the accuracy of detection of the remaining sheet amount value by an associated one of the remaining sheet amount-detecting sensors 124 etc. provided in the respective sheet feed trays 105 etc. makes it possible to detect four levels of the remaining sheet amount value. Therefore, in the present embodiment, the remaining sheet amounts set for the sheet feed trays 105 etc. are each indicated in four levels of "0", "⅓", "⅔" and "maximum (3/3)". In this case, assuming that the maximum value of the number of feedable sheets that can be held in each of the sheet feed trays 105 etc. is 1500, "0" indicates 0 remaining sheets, "⅓" indicates 500 remaining sheets, "⅔" indicates 1000 remaining sheets, and "maximum (3/3)" indicates 1500 remaining sheets.

In the present embodiment, it is assumed that the remaining sheet amount set for each of the sheet feed trays 105 etc. is changed when the value reaches a threshold value which can be detected by an associated one of the remaining sheet amount-detecting sensors 124 etc. Further, in detecting the remaining sheet amount value, the remaining sheet-detecting capability of the associated one of the remaining sheet amount-detecting sensors 124 etc. is corrected based on the thickness of each sheet (basis weight set from the FIG. 7 basis weight change screen) set for an associated one of the sheet feed trays 105 etc.

When the remaining sheet amount values of the respective sheet feed trays 105 etc. are acquired in the step S801, the acquired values are set as remaining sheet counts in a database in which the remaining sheet counts are held (step S802). FIG. 9 is a view of the database holding the remaining sheet counts. In the illustrated example, an MIB (management information base) is used. This database is stored e.g. in the HDD 211.

In FIG. 9, "remaining sheet count" is set to a remaining sheet amount value detected by each of the remaining sheet amount-detecting sensors 124 etc. of the printing apparatus 100 when the printing apparatus 100 is started up. The remaining sheet amount value, however, is e.g. in four levels since the remaining sheet amount value is a value detectable by each of the remaining sheet amount-detecting sensors 124 etc. of the printing apparatus 100, as described above, and hence when the printing apparatus 100 is started up, the remaining sheet counts the respective sheet feed trays 105 etc. are set to remaining sheet amount values that could be detected thereon. In the example illustrated in FIG. 9, as the remaining sheet counts, there are set 1000 (sheets) in the sheet feed tray 105, 1000 (sheets) in the sheet feed tray 106, 1500 (sheets) in the sheet feed tray 120, 500 (sheets) in the sheet feed tray 121, and 500 (sheets) in the sheet feed tray 122, which numbers are all detectable sheet amount values, but this shows a state in which after the startup of the printing apparatus 100, only the sheet feed tray 120 has been used to have its remaining sheet count finally determined, for ease of explanation given below. In the database, "actual remaining sheet amount" indicates the number of actual remaining sheets in each of the sheet feed trays 105 etc., that is, 1400 sheets remaining in the sheet feed tray 105, 1100 sheets remaining in the sheet feed tray 106, 1500 sheets remaining in the sheet feed tray 120, 900 sheets remaining in the sheet feed tray 121, and 750 sheets remaining in the sheet feed tray 122. Note that the record of "actual remaining sheet amount" in FIG. 9 is not actually stored in the database, but is illustrated for convenience of explanation. Actually, the printing apparatus 100 of the present embodiment is incapable of detecting actual remaining sheet amounts per se, and hence it determines a remaining sheet amount in each sheet feed tray based on the associated one of the remaining sheet counts appearing in FIG. 9 and a remaining sheet amount flag associated therewith, referred to hereinafter. That is, records actually stored in the database of the remaining sheet amount value are the record of the remaining sheet counts and the record of the remaining sheet amount flags appearing in FIG. 9. This also applies to FIG. 10, referred to hereinafter.

The remaining sheet amount flag is a flag (final determination flag) indicating whether or not the remaining sheet amount value in each of the sheet feed trays 105 etc. is finally determined. When a remaining amount value of any of the sheet feed trays 105 etc. is detected by an associated one of the remaining sheet amount-detecting sensors 124 etc., causing a change in the remaining amount value, the remaining sheet count of the sheet feed tray is reset to the remaining sheet amount value newly detected by the associated one of the remaining sheet amount-detecting sensors 124 etc., and the remaining sheet amount flag associated therewith is turned on to indicate an occurrence of an event of a match between the remaining sheet count and the remaining sheet amount value. Further, when the remaining sheet amount of any of the sheet feed trays 105 etc. is maximum in the step S802, the CPU 205 turns on a remaining sheet amount flag associated with the sheet feed tray.

When the remaining sheet amount values of the sheet feed trays 105 etc. are set as the remaining sheet counts in the step S802, the CPU 205 determines whether or not a job (print job) is received (step S803). The CPU 205 repeatedly performs the determination in the step S803 (NO to the step S803) until a job is received. Upon receipt of a job (YES to the step S803), the CPU 205 operates as a sheet feed-detecting unit to detect sheet feed from a sheet feed tray set by the job along with execution of the job, and whenever sheet feed is performed (a sheet is fed), the CPU 205 updates the remaining sheet count of a sheet feed tray from which sheet feed has been performed (step S804).

Here, a case will be described by way of example in which the job is executed by feeding sheets from the sheet feed tray 105. In the step S804, when a sheet is fed from the sheet feed tray 105, the CPU 205 subtracts 1 from 1000, which is the current value of the remaining sheet amount value of the sheet feed tray 105, to obtain 999.

When the remaining sheet count of the sheet feed tray 105 is changed in the step S804, the CPU 205 checks whether or not the associated one of the remaining sheet amount-detecting sensors 124 etc. has detected a change in the remaining sheet amount of the sheet feed tray 105 (step S805). In the case of the sheet feed tray 105, the remaining sheet amount-detecting sensor 124 detects that the remaining sheet amount of the sheet feed tray 105 has changed, in timing in which 400 sheets out of an actual remaining sheet amount of 1400 sheets of the same have been printed to make the actual remaining sheet amount of the sheet feed tray 105 equal to 1000 sheets.

The CPU 205 repeatedly executes the steps S804 and S805 until the remaining sheet amount-detecting sensor 124 detects the change in the remaining sheet amount of the sheet feed tray 105 (NO to the step S805). In the case of the sheet feed tray 105, the steps S804 and S805 are repeatedly carried out until the actual remaining sheet amount thereof is decreased to 1000 sheets. Although not shown in FIG. 8, when the print job is terminated during repeated execution of the steps S804 and S805, the CPU 205 returns to the step S803. If the associated one of the remaining sheet amount-detecting sensors 124 etc. detects the change in the remaining sheet amount of the sheet feed tray 105 (YES to the step S805), the CPU 205 proceeds to a step S806. In the case of the sheet feed tray 105, when the actual remaining sheet amount of the sheet feed tray 105 becomes equal to 1000 sheets, the CPU 205 proceeds to the step S806. At this time, the remaining sheet count of the sheet feed tray 105 has been decreased to 600 sheets.

In the step S806, the CPU 205 determines whether or not the sheet feed tray of which a change in the remaining sheet amount has been detected in the step S805 is grouped with any other sheet feed tray in the same group. If the sheet feed tray is not grouped (NO to the step S806), the CPU 205 proceeds to a step S813, wherein the CPU 205 resets the remaining sheet count of the sheet feed tray 105 to the detected remaining sheet amount value, and turns on the remaining sheet amount flag associated with the sheet feed tray 105, which is a final determination flag. In the case of the sheet feed tray 105, the CPU 205, which operates as an actual remaining sheet-correcting unit, changes the remaining sheet count from 1000 to 600. This sets an accurate remaining sheet amount value of the sheet feed tray 105. Then, the CPU 205 performs printing of the remaining part of the job (step S814), and returns to the step S803. Note that also during execution of printing of the remaining part of the job in the step S814, the CPU 205 subtracts 1 from the remaining sheet amount value of the sheet feed tray 105 whenever a sheet is fed from the sheet feed tray 105.

If it is determined that the sheet feed tray is grouped with any other sheet feed tray in the same group (YES to the step S806), the CPU 205 proceeds to a step S807. In the case of the illustrated example in FIG. 3 of the present embodiment, the sheet feed tray 105 is grouped with the sheet feed tray 106, and hence the process proceeds to the step S807. Note that even when the sheet feed tray is not grouped, a case where there is another sheet feed tray, which is set to the same type and size of sheets, may be handled similarly to the case where the sheet feed tray is grouped with another sheet feed tray, and whether there is another sheet feed tray set to the same type and size of sheets may be used as a criterion of the determination in the step S806.

In the step S807, the CPU 205 determines whether or not the sheet feed tray of which a change in the remaining sheet amount has been detected in the step S805 is set to a sheet type of special sheets with an order property. Examples of the sheet type with an order property include tab sheets, no-carbon sheets, etc., and information indicative of whether or not the sheet feed tray is set to a sheet type with an order property is acquired from information set by the user from the sheet setting change screen shown in FIG. 5 and the sheet attribute details-setting screen shown in FIG. 6.

If the sheet feed tray is not set to any sheet type with an order property (NO to the step S807), the CPU 205 directly proceeds to a step S810, referred to hereinafter. If the sheet feed tray is set to a sheet type with an order property (YES to the step S807), the CPU 205 continues printing up to a sheet which enables preservation of the order property of printed sheets (until a last sheet is fed which is required for preserving the order property of printed sheets) without switching between sheet feed trays of the same group (step S808). Note that information indicative of whether or not the last sheet required for preserving the order property of printed sheets has been printed is acquired from the attributes of the print job. Alternatively, information indicative of whether or not the last sheet required for preserving the order property of printed sheets (fifth tab sheet in the case of five-tab sheets) has been printed may be calculated based on the number of printed sheets.

After printing has been continued up to a sheet which enables preservation of the order property, the CPU 205 operates, as an actual remaining sheet amount correction unit, to subtract the number of sheets on which printing has been continued from the remaining sheet amount value detected by an associated one of the remaining sheet amount-detecting sensors 124 etc. (step S809), and proceeds to a step S810. In the step S810, the CPU 205 resets the remaining sheet count to the detected remaining sheet amount value or the detected remaining sheet amount value further subjected to the subtraction, and turns on the final determination flag (remaining sheet amount flag). FIG. 10 shows an example of a state in which the database (MIB) shown in FIG. 9 has been updated in the step S810. As shown in FIG. 10, in the case of the illustrated example, described hereinabove, of the present embodiment, the remaining sheet count of the sheet feed tray 105 becomes equal to 1000, which corresponds to the actual remaining sheet amount, though not actually detected, and the remaining sheet amount flag is turned on.

After execution of the step S810, the CPU 205 checks whether or not the sheet feed trays of the same group include a sheet feed tray of which the remaining sheet count has not been finally determined (step S811). The determination in the step S811 is performed by searching for a sheet feed tray with the associated remaining sheet amount flag being off from the sheet feed trays determined to be in the same group in the step S806. The sheet feed tray 105 is grouped with the sheet feed tray 106, and the remaining sheet amount flag associated with the sheet feed tray 106 is off, so that it is judged that the remaining sheet count of the sheet feed tray 106 has not been finally determined yet.

If the remaining sheet counts of all the sheet feed trays of the same group are finally determined (NO to the step S811), the CPU 205 proceeds to the step S814 to continue to execute the remaining part of the job. Note that an object may be provided for collectively setting the remaining sheet amounts of all the sheet feed trays of the same group. In this object, the total remaining sheet amount of sheet feed trays of each group is set on a group basis, and a final determination flag (remaining sheet amount flag) of the group is turned on when the remaining sheet amount values of all the sheet feed trays of the same group are finally determined.

If the sheet feed trays of the same group include a sheet feed tray of which the remaining sheet count has not been finally determined (YES to the step S811), the CPU 205 switches the sheet feed tray for use in executing the job to the sheet feed tray of which the remaining sheet count has not been finally determined (step S812). As is apparent from FIG. 10, when sheets have been fed from the sheet feed tray 105, the CPU 205 switches the sheet feed tray for use in executing the job from the sheet feed tray 105 to the sheet feed tray 106, and returns to the step S804 to execute processing for finally determining the remaining sheet count of the sheet feed tray 106. Thus, similarly to the case of the sheet feed tray 105, the CPU 205 executes the job until the remaining sheet amount-detecting sensor 125 detects a change in the remaining sheet amount of the sheet feed tray 106.

Note that if there is still another sheet feed tray with the associated final determination flag (remaining sheet amount flag) being off among the sheet feed trays of the same group, the CPU 205 switches the sheet feed tray for use in executing the job to the sheet feed tray. As can be understood from a flow of steps in which when the determination in the step S811 is negative (NO), the CPU 205 proceeds to the step S814, in the preset embodiment, when the final determination flags (remaining sheet amount flags) associated with all the sheet feed trays of the same group are turned on, sheets continue to be fed from the sheet feed tray for which the sheet remaining count is finally determined last time. However, by storing a sheet feed tray finally determined first time, the sheet feed tray for use in executing the job may be switched to the sheet feed tray so as to feed sheets therefrom.

A case where the final determination flag (remaining sheet amount flag) is changed from on to off includes a case where an associated one of the sheet feed trays 105 etc. is opened or when an associated one of the remaining sheet amount-detecting sensors 124 etc. becomes faulty. When any of the sheet feed trays 105 etc. is opened, the associated final determination flag is required to be turned off, irrespective of whether or not the user replenishes the sheet feed tray with sheets. This is because it is impossible to distinguish a case where the user has replenished the sheet feed tray in such an amount that the number of sheets held therein could not reach a threshold value of the associated one of the remaining sheet amount-detecting sensors 124 etc. from a case where the user opened the sheet feed tray but closed it without replenishing the same with sheets. However, when the sheet feed tray could be replenished with sheets in such an amount that the amount of sheets held therein becomes equal to a threshold value detectable by the associated one of the remaining sheet amount-detecting sensors 124 etc., the associated final determination flag may be maintained on.

According to the present embodiment described above, it is possible to determine the remaining sheet count of a sheet feed tray on a single sheet basis, i.e. in units of a single sheet without using a precision sensor capable of detecting the remaining sheet amount value of the sheet feed tray on a single sheet basis. Further, in a case where the printing apparatus is provided with a large number of sheet feed trays which include grouped ones (also in a case where sheets of the same type and the same size are set in a plurality of sheet feed trays), when the remaining sheet count of a sheet feed tray being used for executing a job is finally determined, the sheet feed tray is automatically changed to a next sheet feed tray of which the remaining sheet count has not been finally determined. This makes it possible to expedite the final determination of the remaining sheet counts of all the sheet feed trays. As a consequence, the user can review job scheduling based on the finally determined remaining sheet counts of all the sheet feed trays.

Further, in the case of sheets, such as tab sheets, with an order property, a sheet feed tray is not changed immediately when the remaining sheet amount value thereof is finally determined but it is automatically changed after a job is executed until timing comes which makes it possible to preserve the order property of printed sheets. This makes it unnecessary to ensure the order property even when the same sheet feed tray is employed again as a result of switching between sheet feed trays, and makes it possible to execute a job immediately after one sheet feed tray is switched to another.

Figure 11:
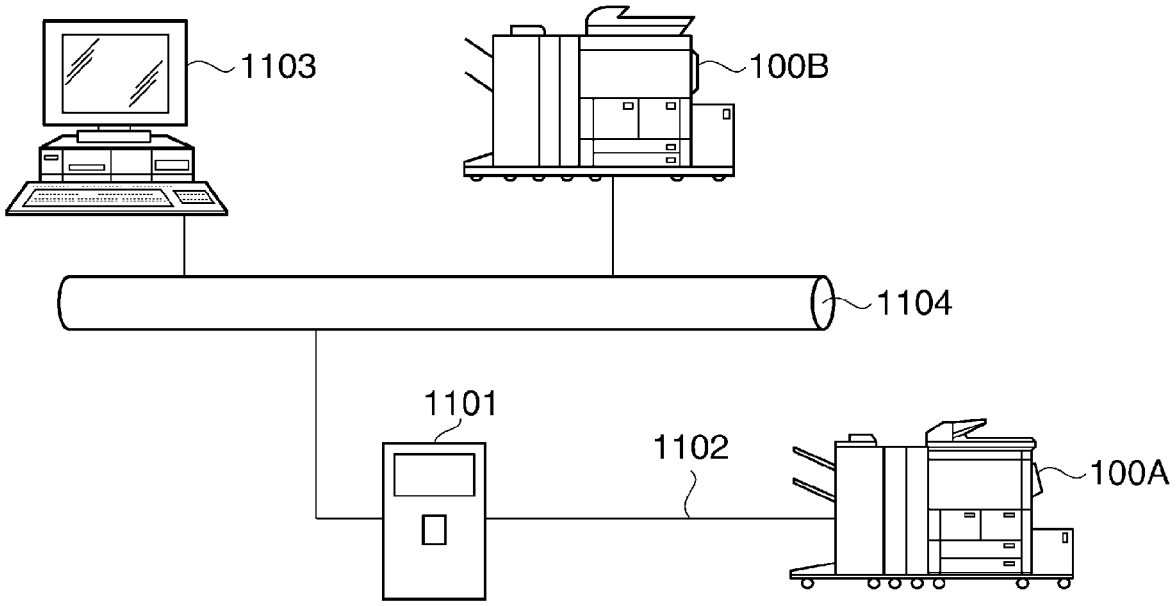
FIG. 11 is a schematic view of an image forming system including an information terminal according to a second embodiment of the present invention and a print control apparatus.

In a second embodiment, an information terminal and a print control apparatus communicably connected to an image forming apparatus correct the remaining counts of sheet feed trays of the image forming apparatus. FIG. 11 is a schematic view of an image forming system including the information terminal according to the second embodiment and the print control apparatus, and illustrates a state of network connection of the image forming system.

The information terminal, denoted by reference numeral 1103, a printing apparatus, denoted by reference numeral 100B, and the print control apparatus, denoted by reference numeral 1101, are connected via a network 1104. The print control apparatus 1101 and a printing apparatus, denoted by 100A. are connected by a dedicated network 1102. Although in the present embodiment, the dedicated network 1102 is used, the dedicated network 1102 may be replaced e.g. by a physical interface or a wireless interface insofar as the print control apparatus 1101 can acquire information from the printing apparatus 100A.

The printing apparatuses 100A and 100B each have the same configuration as that of the printing apparatus 100 according to the first embodiment. The print control apparatus 1101 comprises a CPU, a ROM which stores programs, and a RAM as a storage device, none of which are shown, and acquires and corrects information on sheet feed trays of the printing apparatus 100A. The information terminal 1103 acquires and corrects information on sheet feed trays of the printing apparatus 100B. Note that the specification of a database (MIB) storing the grouping and the remaining sheet amounts of the sheet feed trays of the printing apparatuses 100A and 100B is the same as in the first embodiment, and description thereof is omitted.

Figure 12:
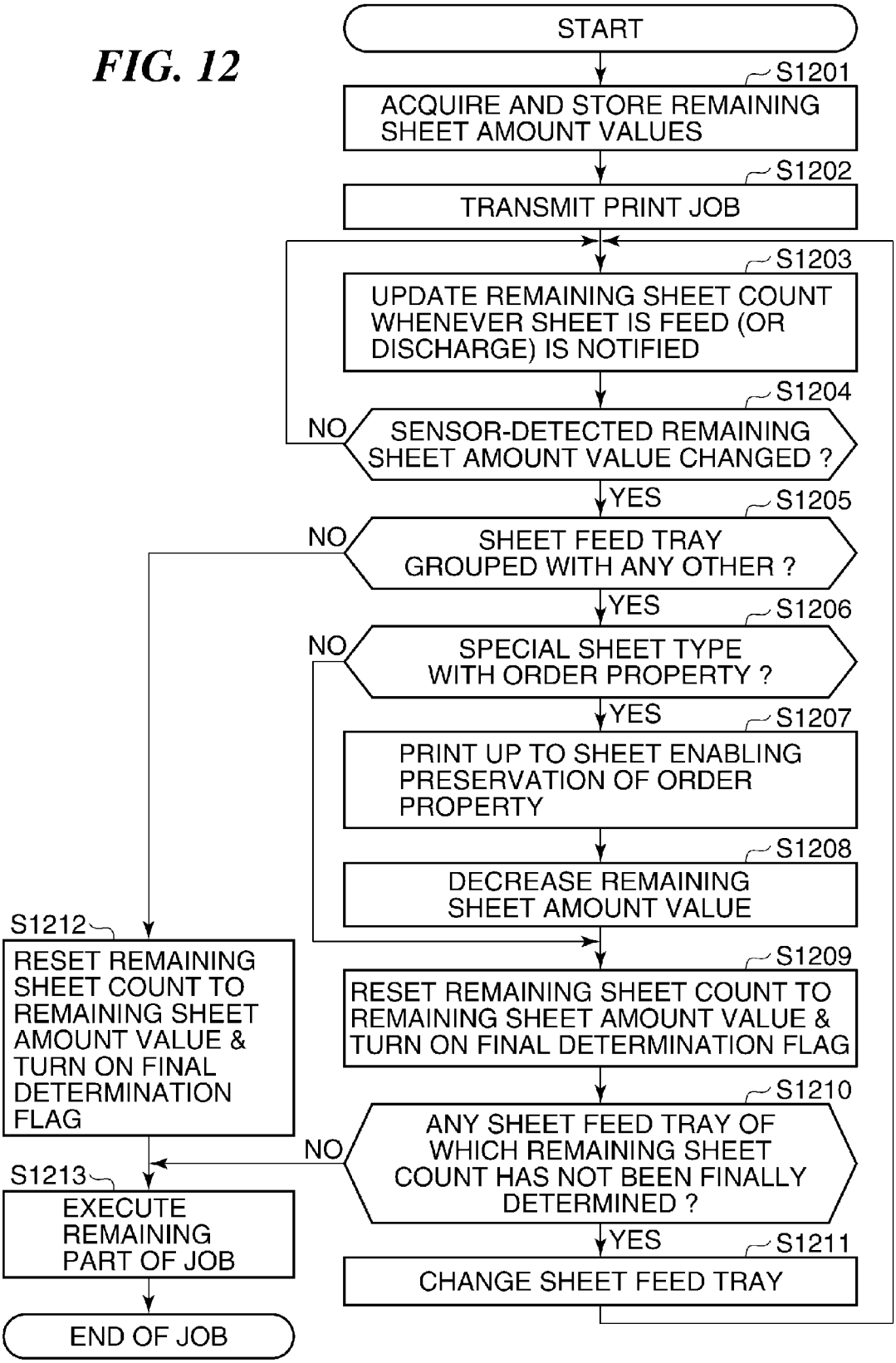
FIG. 12 is a flowchart of a sheet feed tray information-correcting process executed by the print control apparatus appearing in FIG. 11 for correcting information on sheet feed trays of the printing apparatus.

FIG. 12 is a flowchart of a sheet feed tray information-correcting process in which the print control apparatus 1101 corrects information on sheet feed trays of the printing apparatus 100A. The CPU of the print control apparatus 1101 loads an associated program stored in the ROM in a work area of the RAM and executes the same to thereby execute the sheet feed tray information-correcting process shown in FIG. 12.

The CPU of the print control apparatus 1101 operates as a first remaining sheet amount-acquiring unit to acquire remaining sheet amounts set as information on the sheet feed trays from the printing apparatus 100A, before performing a print job (step S1201). The information on the sheet feed trays is acquired from a prtInputTable of a database (MIB) of the printing apparatus 100A, and the remaining sheet amount values in the database (MIB) are acquired as remaining sheet amount values of the printing apparatus 100A. The acquired remaining sheet amount values are stored as remaining sheet counts in a database (MIB similar to the MIB of the printing apparatus 100A) of the print control apparatus 1101. Note that in the present embodiment, correction of the remaining sheet counts of the sheet feed trays is not performed by the printing apparatus 100A, so that the print control apparatus 1101 can acquire only the remaining sheet amount values of the sheet feed tray in four levels (0, ⅓, ⅔and ⅓), which are detected by the remaining sheet amount-detecting sensors 124 etc.

After the step S1201, the CPU of the print control apparatus 1101 transmits the print job to the printing apparatus 100A (step S1202). After that, the CPU of the print control apparatus 1101 awaits reception of a notification of a sheet feed event (or a sheet discharge event) from the printing apparatus 100A. Upon receipt of the sheet feed event (or the sheet discharge event), the CPU updates the remaining sheet count set to the remaining sheet amount value of the sheet feed tray acquired in the step S1201 (step S1203). Specifically, the CPU subtracts 1 from the remaining sheet count of the associated sheet feed tray in the database (MIB) whenever the CPU receives a notification of a sheet feed event (or a sheet discharge event).

After the step S1203, the CPU of the print control apparatus 1101 operates as a second remaining sheet amount-acquiring unit to acquire the remaining sheet amount value of the sheet feed tray in current use from the printing apparatus 100A, and checks whether or not there is a change in the remaining sheet amount value of the sheet feed tray (step S1204). If there is no change in the remaining sheet amount value of the sheet feed tray of the printing apparatus 100A (NO to the step S1204), the CPU of the print control apparatus 1101 returns to the step S1203 and repeatedly executes the steps S1203 and S1204. If the print job is terminated during execution of the steps S1202 and S1203, although not shown, the present process is terminated.

If there is a change in the remaining sheet amount of the sheet feed tray detected by the associated one of the remaining sheet amount-detecting sensors 124 etc. of the printing apparatus 100A (YES to the step S1204), the CPU of the print control apparatus 1101 checks whether or not the sheet feed tray in current use by the printing apparatus 100A for sheet feed is grouped with any other sheet feed tray (step S1205).

If the sheet feed tray is not grouped with any other sheet feed tray (NO to the step S1205), the CPU of the print control apparatus 1101 resets the remaining sheet count of the associated sheet feed tray of the MIB of the print control apparatus 1101 to the remaining sheet amount value after the change, and turns on the remaining sheet amount flag of the sheet feed tray (step S1212). Then, the CPU of the print control apparatus 1101 executes the remaining part of a print job (step S1213) while subtracting 1 from the remaining sheet count of the sheet feed tray whenever a sheet feed event (or a sheet discharge event) is received, followed by terminating the present process. Note that in the step S1205, even when the sheet feed tray is not grouped, a case where there is another sheet feed tray which is set to the same type and size of sheets may be handled similarly to the case where the sheet feed tray is grouped with another sheet feed tray, and whether there is another sheet feed tray set to the same type and size of sheets may be used as a criterion of the determination in the step S1205.

In the step S1206, the CPU of the print control apparatus 1101 determines whether or not the sheet feed tray is set to a sheet type of special sheets with an order property. Examples of the sheet type with an order property include tab sheets, no-carbon sheets, etc. If the sheet feed tray is not set to a sheet type with an order property (NO to the step S1206), the CPU of the print control apparatus 1101 proceeds to a step S1209, referred to hereinafter. On the other hand, if the sheet feed tray is set to a sheet type with an order property (YES to the step S1206), the CPU of the print control apparatus 1101 continues printing up to a sheet which enables preservation of the order property of printed sheets (until a last sheet is fed which is required for preserving the order property of printed sheets) without switching between sheet feed trays of the same group.

Note that information indicative of whether or not the sheet feed tray being in current use is set to a sheet type with an order property is acquired from the prtInputTable of the database (MIB) of the printing apparatus 100A, and information indicative of whether or not the last sheet for preserving the order property has been printed is acquired from attributes of the print job. Alternatively, information indicative of whether or not the last sheet required for preserving the order property of printed sheets (fifth tab sheet in the case of five-tab sheets) has been printed may be calculated based on the number of printed sheets.

After printing has been continued up to a sheet which enables preservation of the order property, the CPU of the print control apparatus 1101 subtracts the number of sheets on which printing has been continued from the detected remaining sheet amount value which changed in the step S1204. Then, the CPU of the print control apparatus 1101 updates the remaining sheet count to the detected remaining sheet amount value after the change or the detected remaining sheet amount value after the change which has been further subjected to the subtraction, and turns on the final determination flag (remaining sheet amount flag) (step S1209), and checks whether or not the sheet feed trays of the same group include a sheet feed tray of which the remaining sheet count has not been finally determined (step S1210).

The determination of whether or not the sheet feed trays of the same group include a sheet feed tray of which the remaining sheet count has not been finally determined is performed by acquiring the values (ON/OFF) of the remaining sheet amount flags of the sheet feed trays that have been determined to be in the same group of the currently used sheet feed tray, in the step S1205 by the CPU of the print control apparatus 1101. If all the acquired values of the remaining sheet amount flags are ON, which means that all the remaining sheet counts are finally determined (NO to the step S1210), the CPU of the print control apparatus 1101 proceeds to the step S1213 to execute the remaining part of the job, followed by terminating the present process. Note that an object may be provided in which the remaining sheet amounts of all the sheet feed trays of the same group are collectively set.

If the sheet feed trays of the same group include a sheet feed tray of which the remaining sheet amount flag is off and hence of which the remaining sheet count has not been finally determined (YES to the step S1210), the CPU of the print control apparatus 1101 instructs the printing apparatus 100A to switch the sheet feed tray (step S1211). When the sheet feed tray is changed by the printing apparatus 100A, the CPU of the print control apparatus 1101 returns to the step S1203 to execute printing using a sheet feed tray to which the sheet feed tray has been switched.

Note that a case where the print control apparatus 1101 changes a remaining sheet amount flag of its own MIB from on to off is a case where an event notifying that a sheet feed tray associated with the remaining sheet amount flag was opened or an event indicating that the sheet feed tray is abnormal has been received from the printing apparatus 100A.

Hereinafter, a description will be given of a case where the information terminal 1103 acquires sheet feed tray information on the printing apparatus 100B using an information collection application (utility software), and corrects the sheet feed tray information. Note that the information collection application may be run on the print control apparatus 1101. In this case, the information collection application may acquire and manage not only the sheet feed tray information on the printing apparatus 100A but also the sheet feed tray information on the printing apparatus 100B.

The sequence of processing of acquisition of the sheet feed tray information on the printing apparatus 100B by the information collection application of the information terminal 1103 is similar to that of the processing of acquisition of the sheet feed tray information by the print control apparatus 1101, but is distinguished from the same in that it does not use a database (MIB). Specifically, the information collection application visually notifies the user of remaining sheet amount values.

Figure 13:
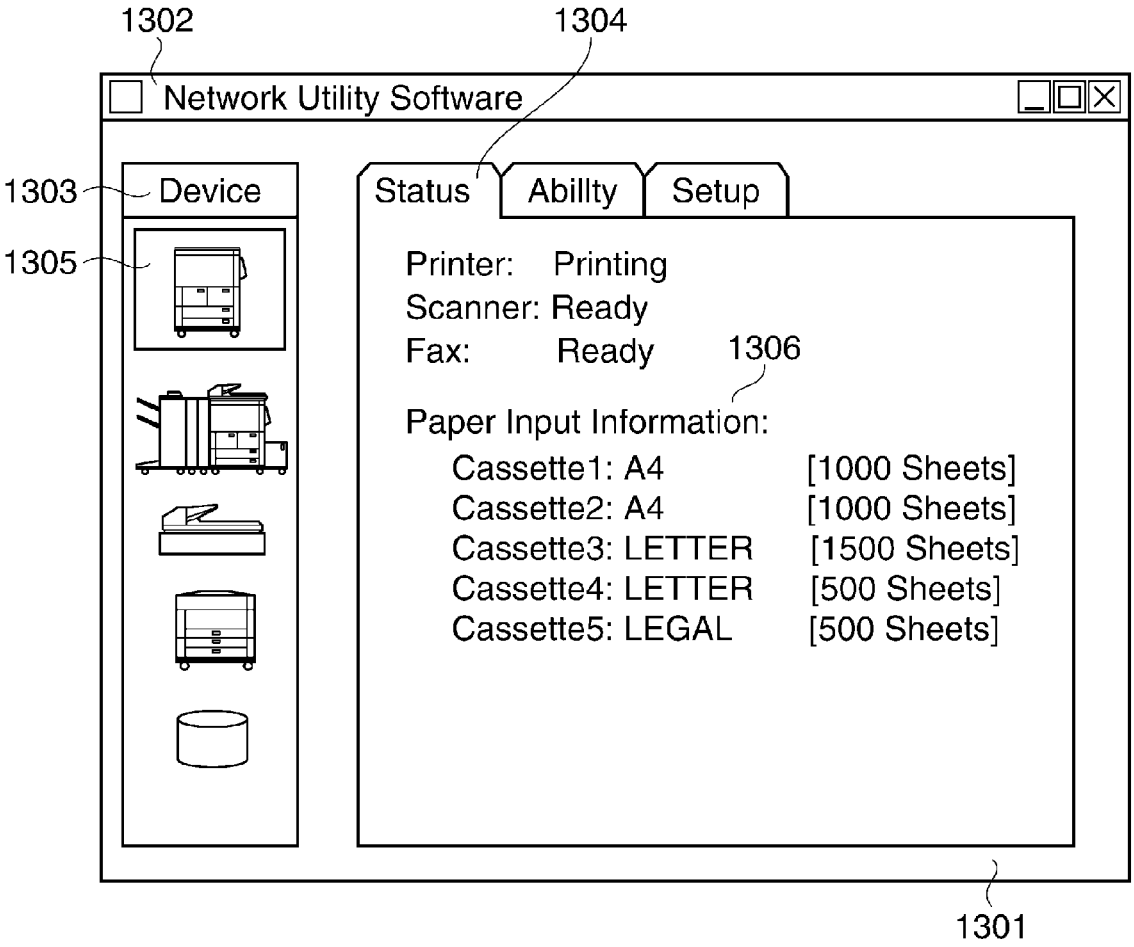
FIG. 13 is a view of a user interface of an application for performing correction of the information on sheet feed trays of the printing apparatus, from the information terminal appearing in FIG. 11.

FIG. 13 is a view of a user interface of the information collection application for performing processing in which the information terminal 1103 acquires and corrects sheet feed tray information on the printing apparatus 100B. A window

1301 of the user interface displays a title bar 1302 for displaying the hierarchical level and title of the current window. The window 1301 of the user interface contains a device list window 1303. The device list window 1303 displays a list of devices (a printer, a scanner, a facsimile machine, and so forth) which are connected to the network 1104, and can be managed by the information collection application.

Further, the window 1301 of the user interface displays a status tab 1304, which is a window for displaying status information on a device as a target of the current management. The status tab 1304 has an information area 1306 showing the current status of use of the device and cassette information on a sheet feed section, and from information area 1306, the user can read sheet feed tray numbers, sheet sizes to which the respective sheet feed trays are set, and remaining sheet amount values, as sheet feed tray information. FIG. 13 displays a state of a device 1305 being selected on the device list window 1303.

The information collection application acquires information on the sheet feed trays of the printing apparatus 100B to correct the contents of the information area 1306. Similarly to the CPU of the print control apparatus 1101, the information collection application acquires remaining sheet amount values of the sheet feed trays of the printing apparatus 100B. Whenever the information collection application acquires a sheet feed event (or a sheet discharge event) transmitted from the printing apparatus 100B, the information collection application updates (subtracts 1 from) the remaining sheet count of an associated one of the sheet feed trays, which is set to the associated remaining sheet amount value acquired from the printing apparatus 100B by the information collection application. When the remaining sheet amount value of the sheet feed tray acquired from the printing apparatus 100B has changed, the information collection application resets (corrects) the remaining sheet count held thereby to the remaining sheet amount value of the sheet feed tray newly acquired from the printing apparatus 100B.

The information collection application can notify the user whether or not the remaining sheet count has been accurately corrected, by displaying the same using different colors between before and after the reset (correction). This notification may be performed by any suitable method other than the above, e.g. using a pop-up form or by changing background colors. It is to be understood that the present embodiment makes it possible to obtain the same advantageous effects as provided by the first embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions. Further, the embodiments of the present invention are described only by way of example, and it is possible to combine the embodiments on an as needed basis. Further, the present invention may be put into practice by arranging the devices for executing the processes shown in FIGS. 4 and 8 on a network, such as the Internet, and providing the above processes as services.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

This application claims priority from Japanese Patent Application No. 2011-105085 filed May 10, 2011, which is hereby incorporated by reference herein in its entirety.

What is claimed is:

1. An image forming apparatus including a plurality of sheet feed trays, comprising:

a remaining sheet amount-detecting unit configured to detect a change of a remaining sheet amount level of each of the plurality of sheet feed trays;

a remaining sheet count-holding unit configured to hold a remaining sheet count of each of the plurality of sheet feed trays;

a sheet feed-detecting unit configured to detect sheet feed from one sheet feed tray, designated by a print job, out of the plurality of sheet feed trays;

an updating unit configured to subtract, whenever said sheet feed-detecting unit detects the sheet feed from the designated sheet feed tray, one from the remaining sheet count of the designated sheet feed tray held by said remaining sheet count-holding unit;

a correction unit configured to correct, in response to said remaining sheet amount-detecting unit detecting a change of a remaining sheet amount level of the designated sheet feed tray, the remaining sheet count of the designated sheet feed tray, which has been updated by said updating unit, to the remaining sheet count corresponding to the remaining sheet amount level after the change detected by said remaining sheet amount-detecting unit; and a control unit configured to change, in response to the remaining sheet count being corrected by said correction unit, sheet feed trays such that sheets are fed from another sheet feed tray, of which a remaining sheet count is not corrected by said correction unit, the another sheet feed tray being one of the sheet feed trays having sheets set therein, the set sheets being the same in type and size with the sheets set in the designated sheet feed tray, wherein said control unit does not change the sheet feed trays in a case where there is not the another sheet feed tray, of which the remaining sheet count is not corrected by said correction unit, and which is one of trays having the sheets set therein, the set sheets being the same in type and size with the sheets set in the designated sheet feed tray.

2. The image forming apparatus according to claim 1, wherein when sheets to which is set the sheet feed tray designated by the print job have an order property, said control unit changes the designated sheet feed tray to the other sheet feed tray after sheet feed is executed until a number of fed sheets enables preservation of the order property of the sheets.

3. The image forming apparatus according to claim 1, wherein the correction unit is configured to correct the remaining sheet count of the designated sheet feed tray, which has been updated by said updating unit, to obtain the remaining sheet count corresponding to the remaining sheet amount level such that the remaining sheet count corresponding to the remaining sheet amount level is less than the remaining sheet count of the designated sheet feed tray, which has been updated by said updating unit, by more than one.

4. An image forming apparatus including a plurality of sheet feed trays, comprising:

a remaining sheet amount-detecting unit configured to detect a change of a remaining sheet amount level of each of the plurality of sheet feed trays;

a remaining sheet count-holding unit configured to hold a remaining sheet count of each of the plurality of sheet feed trays;

a sheet feed-detecting unit configured to detect sheet feed from a sheet feed tray designated by a print job, which is one of the plurality of sheet feed trays;

an updating unit configured to subtract, whenever said sheet feed-detecting unit detects the sheet feed from the designated sheet feed tray, one from the remaining sheet count of the designated sheet feed tray held by said remaining sheet count-holding;

a correction unit configured to correct, in response to said remaining sheet amount-detecting unit detecting a change of a remaining sheet amount level of the designated sheet feed tray, the remaining sheet count of the designated sheet feed tray, which has been updated by said updating unit, to the remaining sheet count corresponding to the remaining sheet amount level after the change detected by said remaining sheet amount-detecting unit; and a control unit configured to change, in response to the remaining sheet count being corrected by said correction unit, sheet feed trays such that sheets are fed from another sheet feed tray, of which a remaining sheet count is not corrected by said correction unit, the another sheet feed tray being one of the sheet feed trays which are grouped with the designated sheet feed tray into the same group, wherein said control unit does not change the sheet feed trays in a case where there is not the another sheet feed tray of which the remaining sheet count is not corrected by said correction unit, the another sheet feed tray being one of trays which are grouped with the designated sheet feed tray into the same group.

5. The image forming apparatus according to claim 4, wherein when sheets to which is set the sheet feed tray designated by the print job have an order property, said control unit changes the designated sheet feed tray to the other sheet feed tray after sheet feed is executed until a number of fed sheets enables preservation of the order property of the sheets.

6. The image forming apparatus according to claim 4, wherein the correction unit is configured to correct the remaining sheet count of the designated sheet feed tray, which has been updated by said updating unit, to obtain the remaining sheet count corresponding to the remaining sheet amount level such that the remaining sheet count corresponding to the remaining sheet amount level is less than the remaining sheet count of the designated sheet feed tray, which has been updated by said updating unit, by more than one.

7. A method of operating an image forming apparatus including a plurality of sheet feed trays, comprising:

detecting a change of a remaining sheet amount level of each of the plurality of sheet feed trays with a remaining sheet amount-detecting unit;

holding a remaining sheet count of each of the plurality of sheet feed trays with a remaining sheet count-holding unit;

detecting a sheet feed from one sheet feed tray, designated by a print job, out of the plurality of sheet feed trays, with a sheet feed-detecting unit;

subtracting one from the remaining sheet count of the designated sheet feed tray held by said remaining sheet count-holding unit with an updating unit configured to be operable, whenever said sheet feed-detecting unit detects the sheet feed from the designated sheet feed tray;

correcting, with a correction unit configured to be responsive to said remaining sheet amount-detecting unit detecting a change of a remaining sheet amount level of the designated sheet feed tray, the remaining sheet count of the designated sheet feed tray, which has been updated by said updating unit, to the remaining sheet count corresponding to the remaining sheet amount level after the change detected by said remaining sheet amount-detecting unit; and changing, in response to the remaining sheet count being corrected by said correction unit, sheet feed trays, utilizing a control unit, such that sheets are fed from another sheet feed tray, of which a remaining sheet count is not corrected by said correction unit, the another sheet feed tray being one of the sheet feed trays having sheets set therein, the set sheets being the same in type and size with the sheets set in the designated sheet feed tray, wherein said control unit does not change the sheet feed trays in a case where there is not the another sheet feed tray, of which the remaining sheet count is not corrected by said correction unit, and which is one of trays having the sheets set therein, the set sheets being the same in type and size with the sheets set in the designated sheet feed tray.

8. A method of operating an image forming apparatus including a plurality of sheet feed trays, comprising:

detecting a change of a remaining sheet amount level of each of the plurality of sheet feed trays with a remaining sheet amount-detecting unit;

holding a remaining sheet count of each of the plurality of sheet feed trays with a remaining sheet count-holding unit;

detecting a sheet feed from a sheet feed tray designated by a print job, which is one of the plurality of sheet feed trays, with a sheet feed-detecting unit;

subtracting one from the remaining sheet count of the designated sheet feed tray held by said remaining sheet count-holding unit with an updating unit configured to be operable whenever said sheet feed-detecting unit detects the sheet feed from the designated sheet feed tray;

correcting the remaining sheet count of the designated sheet feed tray, which has been updated by said updating unit, to the remaining sheet count corresponding to the remaining sheet amount level after the change detected by said remaining sheet amount-detecting unit, with a correction unit configured to be operable, in response to said remaining sheet amount-detecting unit detecting a change of a remaining sheet amount level of the designated sheet feed tray; and changing, in response to the remaining sheet count being corrected by said correction unit, with a control unit, sheet feed trays such that sheets are fed from another sheet feed tray, of which a remaining sheet count is not corrected by said correction unit, the another sheet feed tray being one of the sheet feed trays which are grouped with the designated sheet feed tray into the same group, wherein said control unit does not change the sheet feed trays in a case where there is not the another sheet feed tray of which the remaining sheet count is not corrected by said correction unit, the another sheet feed tray being one of trays which are grouped with the designated sheet feed tray into the same group.

9. A non-transitory computer-readable storage medium storing a computer-executable program for causing a computer to execute a method of controlling an image forming apparatus including a plurality of sheet feed trays, wherein the method comprises:

detecting a change of a remaining sheet amount level of each of the plurality of sheet feed trays with a remaining sheet amount-detecting unit;

holding a remaining sheet count of each of the plurality of sheet feed trays with a remaining sheet count-holding unit;

detecting a sheet feed from one sheet feed tray, designated by a print job, out of the plurality of sheet feed trays, with a sheet feed-detecting unit;

subtracting one from the remaining sheet count of the designated sheet feed tray held by said remaining sheet count-holding unit with an updating unit configured to be operable, whenever said sheet feed-detecting unit detects the sheet feed from the designated sheet feed tray;

correcting, with a correction unit configured to be responsive to said remaining sheet amount-detecting unit detecting a change of a remaining sheet amount level of the designated sheet feed tray, the remaining sheet count of the designated sheet feed tray, which has been updated by said updating unit, to the remaining sheet count corresponding to the remaining sheet amount level after the change detected by said remaining sheet amount-detecting unit; and changing, in response to the remaining sheet count being corrected by said correction unit, sheet feed trays, utilizing a control unit, such that sheets are fed from another sheet feed tray, of which a remaining sheet count is not corrected by said correction unit, the another sheet feed tray being one of the sheet feed trays having sheets set therein, the set sheets being the same in type and size with the sheets set in the designated sheet feed tray, wherein said control unit does not change the sheet feed trays in a case where there is not the another sheet feed tray, of which the remaining sheet count is not corrected by said correction unit, and which is one of trays having the sheets set therein, the set sheets being the same in type and size with the sheets set in the designated sheet feed tray.

10. A non-transitory computer-readable storage medium storing a computer-executable program for causing a computer to execute a method of controlling an image forming apparatus including a plurality of sheet feed trays, wherein the method comprises:

detecting a change of a remaining sheet amount level of each of the plurality of sheet feed trays with a remaining sheet amount-detecting unit;

holding a remaining sheet count of each of the plurality of sheet feed trays with a remaining sheet count-holding unit;

detecting a sheet feed from a sheet feed tray designated by a print job, which is one of the plurality of sheet feed trays, with a sheet feed-detecting unit;

subtracting one from the remaining sheet count of the designated sheet feed tray held by said remaining sheet count-holding unit with an updating unit configured to be operable whenever said sheet feed-detecting unit detects the sheet feed from the designated sheet feed tray;

correcting the remaining sheet count of the designated sheet feed tray, which has been updated by said updating unit, to the remaining sheet count corresponding to the remaining sheet amount level after the change detected by said remaining sheet amount-detecting unit, with a correction unit configured to be operable, in response to said remaining sheet amount-detecting unit detecting a change of a remaining sheet amount level of the designated sheet feed tray; and changing, in response to the remaining sheet count being corrected by said correction unit, with a control unit, sheet feed trays such that sheets are fed from another sheet feed tray, of which a remaining sheet count is not corrected by said correction unit, the another sheet feed tray being one of the sheet feed trays which are grouped with the designated sheet feed tray into the same group, wherein said control unit does not change the sheet feed trays in a case where there is not the another sheet feed tray of which the remaining sheet count is not corrected by said correction unit, the another sheet feed tray being one of trays which are grouped with the designated sheet feed tray into the same group.

* * * * *